US012232552B2

(12) United States Patent
Lotti

(10) Patent No.: US 12,232,552 B2
(45) Date of Patent: Feb. 25, 2025

(54) APPLICATORS FOR APPLYING EYELASH EXTENSIONS AND METHODS FOR USE AND MANUFACTURE THEREOF

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

(21) Appl. No.: 18/220,609

(22) Filed: Jul. 11, 2023

(65) Prior Publication Data

US 2023/0346063 A1 Nov. 2, 2023

Related U.S. Application Data

(63) Continuation of application No. 16/810,787, filed on Mar. 5, 2020, which is a continuation of application No. PCT/US2019/057102, filed on Oct. 19, 2019.
(Continued)

(51) Int. Cl.
*A41G 5/02* (2006.01)
*A45C 11/00* (2006.01)
*B65D 85/00* (2006.01)

(52) U.S. Cl.
CPC ..... *A41G 5/02* (2013.01); *A45C 11/008* (2013.01); *B65D 85/00* (2013.01)

(58) Field of Classification Search
CPC ..... A41G 5/02; A45D 2/48
See application file for complete search history.

(56) References Cited

U.S. PATENT DOCUMENTS 232,595 A 9/1880 Hanisch
783,924 A 2/1905 Boeehm
(Continued)

FOREIGN PATENT DOCUMENTS

CA 216492 A 3/1922
CA 2904764 A1 9/2014
(Continued)

OTHER PUBLICATIONS

Machine Translation Liu (Year: 2017).*
(Continued)

*Primary Examiner* — Rachel R Steitz
*Assistant Examiner* — Brianne E Kalach
(74) *Attorney, Agent, or Firm* — Lowenstein Sandler LLP

(57) ABSTRACT

An applicator includes a first arm and a second arm. Each of the first and second arms includes a medial section extending distally from the proximal end, and a grasping section extending distally from the medial section. The grasping section includes an arcuate portion orientated transverse to the medial section. The arcuate portion has a concave curvature and a convex curvature opposite the concave curvature. A portion of the interior surface of the first arm includes a male portion defined by a protrusion having a first arcuate contour corresponding to at least part of the concave curvature and the convex curvature of the arcuate portion. A portion of the interior surface of the second arm includes a female portion defined by at least one depression having a second arcuate contour corresponding to at least part of the concave curvature and the convex curvature of the arcuate portion.

20 Claims, 13 Drawing Sheets

Related U.S. Application Data

(60) Provisional application No. 62/748,335, filed on Oct. 19, 2018.

(56) References Cited

U.S. PATENT DOCUMENTS

| | | | | |
|---|---|---|---|---|
| 834,683 | A | 10/1906 | Severin | |
| 994,619 | A | 6/1911 | Taylor | |
| 1,021,063 | A | 3/1912 | Miller | |
| 1,450,259 | A | 4/1923 | Charles | |
| 1,657,497 | A | 1/1928 | Cichon | |
| 1,831,801 | A | 11/1931 | Birk | |
| 1,897,747 | A | 2/1933 | Birk | |
| 1,920,401 | A | 8/1933 | Kahn | |
| 1,987,931 | A * | 1/1935 | Goodman | A45D 2/48 132/217 |
| 2,004,046 | A * | 6/1935 | Glaser | A45D 2/48 132/217 |
| 2,013,011 | A | 9/1935 | Sheldon | |
| D101,791 | S | 11/1936 | Rauh | |
| 2,079,256 | A | 5/1937 | Kaiser | |
| D129,526 | S | 9/1941 | Hanisch | |
| 2,268,082 | A | 12/1941 | Phillips, Sr. | |
| 2,323,595 | A | 7/1943 | Hanisch | |
| 2,392,694 | A | 1/1946 | Rector | |
| 2,421,432 | A | 6/1947 | Phillips | |
| D154,227 | S | 6/1949 | Alvizua | |
| D155,559 | S | 10/1949 | Tillmann | |
| 2,618,279 | A | 11/1952 | Reiffert | |
| 2,630,516 | A | 3/1953 | Rausch et al. | |
| 2,812,768 | A | 11/1957 | Giuliano | |
| D189,888 | S | 3/1961 | Tapper | |
| 3,016,059 | A | 1/1962 | Hutton | |
| 3,032,042 | A | 5/1962 | Meehan | |
| 3,032,342 | A | 5/1962 | Glass | |
| 3,174,321 | A | 3/1965 | Williams | |
| 3,245,416 | A | 4/1966 | Aylott | |
| 3,266,500 | A | 8/1966 | Weld | |
| 3,295,534 | A | 1/1967 | Dorkin | |
| 3,306,139 | A | 2/1967 | Brackett | |
| 3,315,689 | A | 4/1967 | Mehron | |
| 3,339,561 | A | 9/1967 | Brickner | |
| 3,343,552 | A | 9/1967 | Steffen | |
| D210,180 | S | 2/1968 | Solomon | |
| 3,392,727 | A | 7/1968 | Hanlon | |
| D213,239 | S | 1/1969 | Flewwellin | |
| 3,447,540 | A | 6/1969 | Osher | |
| 3,454,015 | A | 7/1969 | Udes | |
| 3,461,886 | A | 8/1969 | Bau | |
| D215,985 | S | 11/1969 | Silson | |
| 3,478,754 | A | 11/1969 | Martin, Jr. | |
| 3,491,775 | A | 1/1970 | Aylott | |
| 3,516,423 | A | 6/1970 | Seidler | |
| 3,547,135 | A * | 12/1970 | Roos | A41G 5/02 D28/36 |
| 3,557,653 | A | 1/1971 | Kim | |
| D219,854 | S | 2/1971 | Howard | |
| 3,561,454 | A | 2/1971 | O'Connell | |
| D222,518 | S | 10/1971 | Brittain | |
| 3,625,229 | A | 12/1971 | Silson | |
| 3,645,281 | A | 2/1972 | Seidler | |
| 3,670,742 | A | 6/1972 | Weaner | |
| 3,703,180 | A | 11/1972 | Aylott | |
| 3,818,784 | A | 6/1974 | McClure | |
| 3,828,803 | A | 8/1974 | Windsor | |
| 3,833,007 | A | 9/1974 | Jacobs | |
| 3,900,038 | A | 8/1975 | Masters | |
| D240,769 | S | 7/1976 | Bowman | |
| 3,968,807 | A | 7/1976 | Kraicer | |
| 3,970,092 | A | 7/1976 | Nelson | |
| 3,970,992 | A | 7/1976 | Boothroyd et al. | |
| 3,971,392 | A | 7/1976 | Brehmer | |
| 3,980,092 | A | 9/1976 | Garufi | |
| 3,982,313 | A | 9/1976 | Nelson, Jr. | |
| 4,016,889 | A | 4/1977 | Cowles | |
| 4,018,336 | A | 4/1977 | Aylott | |
| 4,029,111 | A | 6/1977 | Barton | |
| 4,049,006 | A | 9/1977 | Saunders | |
| 4,163,535 | A | 8/1979 | Austin | |
| 4,168,713 | A | 9/1979 | Agiotis | |
| 4,203,518 | A | 5/1980 | Current | |
| 4,205,693 | A | 6/1980 | Mallouf | |
| 4,225,693 | A | 9/1980 | McCormick | |
| 4,254,772 | A | 3/1981 | McNamee | |
| 4,254,784 | A | 3/1981 | Nelson | |
| 4,284,092 | A | 8/1981 | Auretta | |
| 4,296,765 | A | 10/1981 | Bachtell | |
| D261,601 | S | 11/1981 | Kettlestrings | |
| 4,299,242 | A | 11/1981 | Choe | |
| 4,360,033 | A | 11/1982 | Schmehling | |
| D269,820 | S | 7/1983 | Bisson | |
| 4,395,824 | A | 8/1983 | Puro | |
| D270,551 | S | 9/1983 | Thayer | |
| 4,458,701 | A | 7/1984 | Holland | |
| 4,509,539 | A | 4/1985 | Alfieri | |
| D280,354 | S | 8/1985 | Bakic | |
| D281,259 | S | 11/1985 | Hensley | |
| D281,825 | S | 12/1985 | Bakic | |
| 4,600,029 | A | 7/1986 | Ueberschaar | |
| 4,697,856 | A | 10/1987 | Abraham | |
| 4,739,777 | A | 4/1988 | Nelson | |
| 4,761,028 | A | 8/1988 | Dulebohn | |
| 4,767,492 | A | 8/1988 | Fukusima et al. | |
| D298,070 | S | 10/1988 | Ferrari | |
| 4,784,713 | A | 11/1988 | Van Nieulande | |
| D299,561 | S | 1/1989 | Bakic | |
| D301,371 | S | 5/1989 | Kaprelian | |
| D302,602 | S | 8/1989 | Bakic | |
| 4,865,057 | A | 9/1989 | Braun | |
| 4,934,387 | A | 6/1990 | Megna | |
| 4,964,428 | A | 10/1990 | Lamatrice | |
| D314,066 | S | 1/1991 | Bakic | |
| 5,003,467 | A | 3/1991 | Donaldson et al. | |
| 5,010,914 | A | 4/1991 | Merges | |
| D318,346 | S | 7/1991 | Bakic | |
| 5,033,626 | A | 7/1991 | Platti | |
| 5,072,745 | A | 12/1991 | Cheh | |
| 5,082,010 | A | 1/1992 | Skaryd | |
| 5,117,846 | A | 6/1992 | Finamore | |
| D328,246 | S | 7/1992 | Nottingham | |
| 5,154,195 | A | 10/1992 | Irisawa | |
| D342,671 | S | 12/1993 | Elliott | |
| D343,340 | S | 1/1994 | Frye, Jr. et al. | |
| 5,307,826 | A | 5/1994 | Iosilevich | |
| D348,219 | S | 6/1994 | Goldberg | |
| 5,322,166 | A | 6/1994 | Crowther | |
| 5,368,052 | A | 11/1994 | Finamore | |
| 5,377,700 | A | 1/1995 | Harris | |
| D358,312 | S | 5/1995 | Keenan | |
| D358,908 | S | 5/1995 | Rawski | |
| 5,411,775 | A | 5/1995 | Wilson | |
| 5,419,345 | A | 5/1995 | Kadymir | |
| D359,583 | S | 6/1995 | Abbo | |
| D368,495 | S | 4/1996 | Rypinski | |
| 5,533,529 | A | 7/1996 | Ohno | |
| 5,547,529 | A | 8/1996 | Woolf | |
| D373,726 | S | 9/1996 | Power | |
| 5,571,543 | A | 11/1996 | Song | |
| D379,923 | S | 6/1997 | De Baschmakoff | |
| D380,616 | S | 7/1997 | Leslie | |
| D382,198 | S | 8/1997 | Mulhauser | |
| D386,808 | S | 11/1997 | Litton | |
| D387,483 | S | 12/1997 | Sloan | |
| D388,549 | S | 12/1997 | Mouyiaris | |
| 5,746,232 | A | 5/1998 | Martin | |
| 5,765,571 | A | 6/1998 | Dinnel | |
| D397,040 | S | 8/1998 | Bakic | |
| 5,813,418 | A | 9/1998 | Pillars | |
| D403,922 | S | 1/1999 | Terracciano | |
| D404,531 | S | 1/1999 | Bakic | |
| 5,894,846 | A | 4/1999 | Gang | |
| 5,896,996 | A | 4/1999 | Chuang | |
| D411,649 | S | 6/1999 | Bakic | |
| 5,944,028 | A | 8/1999 | Gebhard | |

(56) References Cited

U.S. PATENT DOCUMENTS

| | | | |
|---|---|---|---|
| D418,018 | S | 12/1999 | Winsted |
| D418,253 | S | 12/1999 | Bakic |
| 6,003,467 | A | 12/1999 | Shelton-Ferrell |
| 6,016,814 | A | 1/2000 | Elliott |
| 6,019,107 | A | 2/2000 | Overmyer |
| 6,029,674 | A | 2/2000 | Han |
| 6,032,609 | A | 3/2000 | Luoma |
| 6,035,861 | A | 3/2000 | Copello |
| 6,092,291 | A | 7/2000 | Cendoma |
| 6,109,274 | A | 8/2000 | Ingersoll |
| D437,086 | S | 1/2001 | Dickert |
| 6,174,321 | B1 | 1/2001 | Webb |
| 6,182,839 | B1 | 2/2001 | Robbins et al. |
| D442,304 | S | 5/2001 | Huang |
| 6,230,715 | B1 | 5/2001 | Cho |
| D443,471 | S | 6/2001 | Lillelund |
| 6,247,476 | B1 | 6/2001 | Sartena |
| 6,257,250 | B1 | 7/2001 | Sartena |
| 6,265,010 | B1 | 7/2001 | Franco |
| D448,927 | S | 10/2001 | Vazquez |
| 6,302,115 | B1 | 10/2001 | Sartena |
| 6,308,716 | B1 | 10/2001 | Han |
| D452,151 | S | 12/2001 | Scott |
| 6,325,071 | B1 | 12/2001 | Butcher |
| D454,981 | S | 3/2002 | Lamagna |
| D456,077 | S | 4/2002 | Etter |
| D456,097 | S | 4/2002 | Lamagna |
| D458,413 | S | 6/2002 | Boilen |
| 6,405,736 | B2 | 6/2002 | Townsend |
| 6,439,406 | B1 | 8/2002 | Duhon |
| D463,280 | S | 9/2002 | Brozell |
| D463,744 | S | 10/2002 | Brozell |
| D464,565 | S | 10/2002 | Weinstein |
| D464,877 | S | 10/2002 | Weinstein |
| 6,471,515 | B2 | 10/2002 | Feuer |
| D467,800 | S | 12/2002 | Chen |
| 6,494,212 | B1 | 12/2002 | Yamakoshi |
| 6,530,379 | B2 | 3/2003 | Iosilevich |
| D472,675 | S | 4/2003 | Lamagna |
| D472,810 | S | 4/2003 | Gelardi |
| D473,106 | S | 4/2003 | Scherer |
| 6,561,197 | B2 | 5/2003 | Harrison |
| 6,567,640 | B2 | 5/2003 | Ishikawa |
| D475,616 | S | 6/2003 | Lambrecht |
| 6,581,609 | B2 | 6/2003 | Ott |
| D479,365 | S | 9/2003 | Todeschini |
| D480,864 | S | 10/2003 | Sayers et al. |
| D481,946 | S | 11/2003 | Nicholson |
| D481,952 | S | 11/2003 | Orsomando |
| D482,495 | S | 11/2003 | Jackel-Marken |
| D482,928 | S | 12/2003 | Liu |
| D482,934 | S | 12/2003 | Liu |
| D483,232 | S | 12/2003 | Liu |
| D483,633 | S | 12/2003 | Jansson |
| D483,909 | S | 12/2003 | Todeschini |
| D485,359 | S | 1/2004 | McMichael |
| 6,688,315 | B1 | 2/2004 | Harrison |
| 6,691,714 | B1 | 2/2004 | Yaguchi |
| 6,708,696 | B2 | 3/2004 | Ferguson |
| D488,353 | S | 4/2004 | Govrik et al. |
| D488,618 | S | 4/2004 | Wekstein |
| D490,932 | S | 6/2004 | Mammone |
| D491,336 | S | 6/2004 | Cecere |
| D495,834 | S | 9/2004 | Todeschini |
| D496,759 | S | 9/2004 | Rodriguez |
| 6,789,551 | B2 | 9/2004 | Iosilevich |
| 6,820,625 | B2 | 11/2004 | Park |
| D501,580 | S | 2/2005 | Sugawara |
| D506,573 | S | 6/2005 | de Grandcourt |
| D507,678 | S | 7/2005 | Lamagna |
| 6,935,348 | B2 | 8/2005 | Gold |
| 6,935,349 | B2 | 8/2005 | Nicot |
| D509,942 | S | 9/2005 | Connolly |
| D512,913 | S | 12/2005 | Gauthier |
| 6,973,931 | B1 | 12/2005 | King |
| 6,981,814 | B2 | 1/2006 | Geardino |
| D515,242 | S | 2/2006 | Cho |
| D515,742 | S | 2/2006 | Anderson et al. |
| D516,247 | S | 2/2006 | Merheje |
| 7,000,775 | B2 | 2/2006 | Gelardi |
| 7,036,518 | B2 | 5/2006 | Park |
| D522,376 | S | 6/2006 | Hales |
| 7,128,213 | B2 | 10/2006 | Tung et al. |
| D532,891 | S | 11/2006 | Buthier |
| D533,650 | S | 12/2006 | Ohta |
| 7,147,127 | B2 | 12/2006 | Lepke et al. |
| D534,426 | S | 1/2007 | Bakic |
| 7,159,720 | B2 | 1/2007 | Pearson |
| 7,168,432 | B1 | 1/2007 | Brumfield |
| D537,208 | S | 2/2007 | Shaljian |
| D540,112 | S | 4/2007 | Nichols |
| D543,662 | S | 5/2007 | Bivona |
| D543,663 | S | 5/2007 | Bivona et al. |
| D543,815 | S | 6/2007 | Metcalf |
| D543,850 | S | 6/2007 | Legros |
| D544,148 | S | 6/2007 | Bivona |
| D544,202 | S | 6/2007 | Markfelder |
| D545,396 | S | 6/2007 | Casey |
| 7,228,863 | B2 | 6/2007 | Dumler |
| D546,002 | S | 7/2007 | Bowen |
| D547,940 | S | 8/2007 | Sandy |
| D559,457 | S | 1/2008 | Garland |
| D561,045 | S | 2/2008 | Lee |
| D561,357 | S | 2/2008 | Leclercq |
| D561,942 | S | 2/2008 | Khubani |
| 7,331,351 | B1 | 2/2008 | Asai |
| D563,157 | S | 3/2008 | Bouveret |
| D563,616 | S | 3/2008 | Lynde |
| D563,728 | S | 3/2008 | Welch, III |
| 7,343,921 | B2 | 3/2008 | Salinas |
| D569,041 | S | 5/2008 | Azoulay |
| D569,553 | S | 5/2008 | Cho |
| 7,374,048 | B2 | 5/2008 | Mazurek |
| D571,543 | S | 6/2008 | Sungadi |
| D573,306 | S | 7/2008 | Yoo |
| D573,308 | S | 7/2008 | Wittke-Kothe |
| D575,904 | S | 8/2008 | Iqbal |
| D579,059 | S | 10/2008 | Chan |
| 7,469,701 | B1 | 12/2008 | Bernard |
| D584,449 | S | 1/2009 | Shaljian |
| D587,529 | S | 3/2009 | Pratt |
| D588,746 | S | 3/2009 | Ross |
| 7,501,178 | B2 | 3/2009 | Sato |
| D591,599 | S | 5/2009 | Okin |
| D592,917 | S | 5/2009 | Jalet et al. |
| D592,923 | S | 5/2009 | Konopka |
| 7,533,676 | B2 | 5/2009 | Sthair |
| D595,054 | S | 6/2009 | Whitaker |
| 7,543,718 | B2 | 6/2009 | Simon |
| D600,441 | S | 9/2009 | Estrada |
| D602,354 | S | 10/2009 | Dibnah |
| 7,600,519 | B2 | 10/2009 | Dinh |
| D604,579 | S | 11/2009 | Robinson |
| 7,610,921 | B2 | 11/2009 | Gold |
| D605,514 | S | 12/2009 | Weber |
| 7,637,265 | B2 | 12/2009 | Funatsu et al. |
| D607,332 | S | 1/2010 | Huntington |
| D615,290 | S | 5/2010 | Heffner |
| D617,187 | S | 6/2010 | Murray |
| D617,943 | S | 6/2010 | Bouix |
| D618,078 | S | 6/2010 | Cripps |
| 7,748,391 | B2 | 7/2010 | Vance |
| D627,103 | S | 11/2010 | Cho |
| 7,836,899 | B2 | 11/2010 | Sugai |
| D631,606 | S | 1/2011 | Chen |
| 7,896,192 | B2 | 3/2011 | Conley et al. |
| D636,127 | S | 4/2011 | Allison et al. |
| D638,733 | S | 5/2011 | Sullivan |
| 7,938,128 | B2 | 5/2011 | Gueret |
| D639,196 | S | 6/2011 | Sullivan |
| D640,005 | S | 6/2011 | Lee |
| D640,834 | S | 6/2011 | Chen |
| D641,106 | S | 7/2011 | Williams |
| 8,015,980 | B2 | 9/2011 | Rabe |

(56) References Cited

U.S. PATENT DOCUMENTS

| | | | |
|---|---|---|---|
| 8,025,065 | B2 | 9/2011 | Guliker |
| 8,042,553 | B2 | 10/2011 | Paris |
| D647,799 | S | 11/2011 | Dunwoody |
| 8,061,367 | B2 | 11/2011 | Rabe |
| D650,669 | S | 12/2011 | Dunwoody |
| D650,670 | S | 12/2011 | Dunwoody |
| D651,082 | S | 12/2011 | Dunwoody |
| 8,113,218 | B2 | 2/2012 | Nguyen |
| 8,127,774 | B2 | 3/2012 | Dinh |
| D657,496 | S | 4/2012 | Flatt |
| D657,696 | S | 4/2012 | Floyd |
| D659,330 | S | 5/2012 | Davis |
| 8,171,943 | B2 | 5/2012 | Hamano |
| 8,186,361 | B2 | 5/2012 | Hampton |
| D661,185 | S | 6/2012 | Battat |
| D661,599 | S | 6/2012 | Floyd |
| 8,191,556 | B2 | 6/2012 | Betts |
| 8,196,591 | B2 | 6/2012 | Lee |
| 8,205,761 | B2 | 6/2012 | Stull, Sr. |
| D663,113 | S | 7/2012 | Simms |
| D664,011 | S | 7/2012 | Affonso |
| 8,225,800 | B2 | 7/2012 | Byrne |
| D669,223 | S | 10/2012 | Lee |
| D670,030 | S | 10/2012 | Nguyen |
| D673,325 | S | 12/2012 | Martines |
| 8,342,186 | B2 | 1/2013 | Freelove |
| 8,347,896 | B2 | 1/2013 | Liao |
| D679,590 | S | 4/2013 | Stull, Sr. |
| D679,591 | S | 4/2013 | Stull, Sr. et al. |
| D679,592 | S | 4/2013 | Stull, Sr. et al. |
| D679,595 | S | 4/2013 | Stull, Sr. |
| D679,596 | S | 4/2013 | Stull, Sr. |
| D682,103 | S | 5/2013 | Jedlicka |
| D682,688 | S | 5/2013 | Murray |
| 8,434,500 | B2 | 5/2013 | Alex |
| D686,495 | S | 7/2013 | Murray |
| D690,419 | S | 9/2013 | Porat |
| 8,528,571 | B2 | 9/2013 | Costa |
| 8,567,640 | B1 | 10/2013 | Johnson-Lofton |
| 8,578,946 | B2 | 11/2013 | Ellery |
| 8,590,543 | B2 | 11/2013 | Goff et al. |
| 8,596,284 | B2 | 12/2013 | Byrne |
| 8,616,223 | B2 | 12/2013 | Rabe |
| D698,078 | S | 1/2014 | Purizhansky |
| 8,657,170 | B2 | 2/2014 | Martinez |
| D700,799 | S | 3/2014 | Ludeman |
| 8,672,377 | B2 | 3/2014 | Ina |
| D702,510 | S | 4/2014 | Segal |
| 8,701,685 | B2 | 4/2014 | Chipman |
| D707,392 | S | 6/2014 | Yu |
| D707,556 | S | 6/2014 | Kawamura |
| 8,739,803 | B2 | 6/2014 | Freelove |
| 8,752,562 | B2 | 6/2014 | Dinh |
| D709,129 | S | 7/2014 | Moertl |
| D711,227 | S | 8/2014 | Sheikh |
| D713,217 | S | 9/2014 | Micara-Sartori |
| D714,494 | S | 9/2014 | Vasquez |
| 8,826,919 | B2 | 9/2014 | Dinh |
| D716,498 | S | 10/2014 | Wolff |
| D717,038 | S | 11/2014 | Lee |
| D717,536 | S | 11/2014 | Gupta |
| D718,498 | S | 11/2014 | Gu |
| 8,875,718 | B2 | 11/2014 | Dinh |
| 8,881,741 | B1 | 11/2014 | Mattson |
| 8,881,744 | B2 | 11/2014 | Mckinstry |
| D718,901 | S | 12/2014 | Parker |
| 8,939,159 | B2 | 1/2015 | Yeo |
| 8,967,158 | B2 | 3/2015 | Sanbonmatsu |
| 9,004,076 | B2 | 4/2015 | Le |
| 9,004,299 | B2 | 4/2015 | Hardin |
| 9,027,568 | B2 | 5/2015 | Lee |
| 9,044,076 | B2 | 6/2015 | Temple |
| 9,078,480 | B2 | 7/2015 | Beschta |
| 9,107,461 | B2 | 8/2015 | Martins |
| D738,579 | S | 9/2015 | Owens |
| D738,611 | S | 9/2015 | Gupta |
| 9,149,083 | B1 | 10/2015 | Dinh |
| 9,155,345 | B2 | 10/2015 | Nisim |
| 9,179,722 | B2 | 11/2015 | Le |
| 9,185,943 | B2 | 11/2015 | Merszei |
| D746,046 | S | 12/2015 | Lee |
| D746,514 | S | 12/2015 | Lambridis |
| 9,215,901 | B1 | 12/2015 | Schroeder |
| 9,254,012 | B2 | 2/2016 | Pham |
| D751,904 | S | 3/2016 | Landrum |
| 9,277,777 | B2 | 3/2016 | Lee |
| 9,284,111 | B2 | 3/2016 | Huang |
| D753,455 | S | 4/2016 | Hyma |
| D753,881 | S | 4/2016 | Hussain |
| 9,314,085 | B2 | 4/2016 | Hatch |
| D755,577 | S | 5/2016 | Segal |
| D757,274 | S | 5/2016 | Gelb |
| D758,009 | S | 5/2016 | Berkos |
| 9,339,072 | B2 | 5/2016 | Kenna |
| 9,351,752 | B2 | 5/2016 | Slavin |
| D761,489 | S | 7/2016 | Krakovszki |
| D762,433 | S | 8/2016 | Yang |
| D764,688 | S | 8/2016 | Robinson |
| D765,909 | S | 9/2016 | Marchica |
| 9,433,421 | B2 | 9/2016 | Ueno et al. |
| 9,439,465 | B2 | 9/2016 | Ott |
| 9,451,800 | B2 | 9/2016 | Dinh |
| 9,456,646 | B2 | 10/2016 | Calina |
| 9,462,837 | B2 | 10/2016 | Ngo |
| 9,468,245 | B2 | 10/2016 | Woods |
| D771,318 | S | 11/2016 | Taff |
| 9,486,025 | B1 | 11/2016 | Dinh |
| 9,504,285 | B2 | 11/2016 | Lin |
| D773,915 | S | 12/2016 | Barakat |
| D775,270 | S | 12/2016 | Moffat |
| 9,516,908 | B2 | 12/2016 | Miyatake |
| 9,565,883 | B2 | 2/2017 | Dinh |
| D780,994 | S | 3/2017 | Hardwick |
| 9,596,898 | B2 | 3/2017 | Seawright |
| D783,899 | S | 4/2017 | Roh |
| D783,901 | S | 4/2017 | Kim |
| D784,615 | S | 4/2017 | Choi |
| 9,622,527 | B2 | 4/2017 | Nguyen |
| D788,556 | S | 6/2017 | James |
| 9,730,481 | B2 | 8/2017 | Uresti |
| D796,582 | S | 9/2017 | Beard |
| D800,966 | S | 10/2017 | Silva |
| 9,815,655 | B2 | 11/2017 | Crapet et al. |
| D805,135 | S | 12/2017 | Beard |
| D806,315 | S | 12/2017 | Hardwick |
| 9,833,028 | B2 | 12/2017 | Jang |
| 9,848,661 | B2 | 12/2017 | Harris |
| 9,848,662 | B2 | 12/2017 | Dinh |
| D810,534 | S | 2/2018 | Liu |
| D810,543 | S | 2/2018 | Astradsson |
| D811,872 | S | 3/2018 | Wu |
| D812,303 | S | 3/2018 | Pascullo |
| D814,107 | S | 3/2018 | Lotti |
| D814,260 | S | 4/2018 | Dhubb |
| 9,930,919 | B1 | 4/2018 | Branker |
| 9,946,169 | B2 | 4/2018 | Endo |
| D817,132 | S | 5/2018 | Yang |
| D819,891 | S | 6/2018 | Kenig et al. |
| 9,993,373 | B2 | 6/2018 | Nassif |
| D823,538 | S | 7/2018 | Ruggaber |
| D823,683 | S | 7/2018 | Caldwell |
| D825,333 | S | 8/2018 | Ozamiz |
| D826,019 | S | 8/2018 | Keehner |
| D828,013 | S | 9/2018 | van Wijngaarden |
| D828,014 | S | 9/2018 | van Wijngaarden |
| D828,629 | S | 9/2018 | Hussain |
| D829,381 | S | 9/2018 | Kim |
| D830,170 | S | 10/2018 | Holmes |
| D832,701 | S | 11/2018 | Oates |
| D832,702 | S | 11/2018 | Oates |
| D835,465 | S | 12/2018 | Son |
| D836,432 | S | 12/2018 | Riedel |
| 10,149,528 | B2 | 12/2018 | Erickson |
| D836,943 | S | 1/2019 | Klieman |

(56) References Cited

U.S. PATENT DOCUMENTS

D837,653 S 1/2019 Meranus
D840,104 S 2/2019 Hussain
10,264,837 B2 4/2019 Park
D847,631 S 5/2019 Villbrandt
D847,632 S 5/2019 Villbrandt
D848,795 S 5/2019 Butler
D850,715 S 6/2019 Lotti
D852,412 S 6/2019 Grund
10,362,823 B1 7/2019 Hill
D862,796 S 10/2019 Jin Kim
D863,419 S 10/2019 Oguma et al.
D863,679 S 10/2019 Lotti
10,433,607 B2 10/2019 Ahn
D867,664 S 11/2019 Lotti
D867,668 S 11/2019 Lotti
10,479,566 B2 11/2019 Doyle et al.
D871,673 S 12/2019 Qureshi
10,532,861 B2 1/2020 Kimmel et al.
D877,416 S 3/2020 Lotti
D884,273 S 5/2020 Liu
10,638,826 B2 5/2020 Lotti
10,660,388 B2 5/2020 Lotti
D890,430 S 7/2020 Lotti
10,721,984 B2 7/2020 Lotti
D895,201 S 9/2020 Lotti
10,791,782 B2 10/2020 Nakamura et al.
10,892,048 B2 1/2021 Reddy et al.
D909,680 S 2/2021 Hussain
D914,965 S 3/2021 Lotti
D920,400 S 5/2021 Saito
D932,101 S 9/2021 Davis
D937,482 S 11/2021 Kim
11,172,749 B2 11/2021 Lotti
11,219,260 B2 1/2022 Lotti
11,234,472 B2 2/2022 Lotti
11,253,020 B2 2/2022 Lotti
D952,258 S 5/2022 Lotti
11,330,855 B2 5/2022 Lotti
11,330,856 B2 5/2022 Lotti
D955,635 S 6/2022 Lotti
D955,645 S 6/2022 Lotti
11,446,017 B2 9/2022 Klassen
D971,505 S 11/2022 Lotti
D971,506 S 11/2022 Lotti
D987,891 S 5/2023 Lotti
D1,006,319 S 11/2023 Lotti
11,832,710 B2 12/2023 Lotti
2001/0023699 A1 9/2001 Matthews
2001/0035192 A1 11/2001 Townsend
2001/0037813 A1 11/2001 Ra
2002/0056465 A1 5/2002 Shin
2002/0094507 A1 7/2002 Feuer
2002/0103421 A1 8/2002 Putrino et al.
2002/0114657 A1 8/2002 Gueret
2002/0127514 A1 9/2002 Dietrich
2002/0198597 A1 12/2002 Godfrey
2003/0005941 A1 1/2003 Iosilevich
2003/0111467 A1 6/2003 Norman
2003/0155317 A1 8/2003 McNeeley
2003/0226571 A1 12/2003 Rahman
2004/0011371 A1 1/2004 Harrison
2004/0011372 A1 1/2004 Park
2004/0051327 A1 3/2004 Yoon
2004/0079382 A1 4/2004 Profitt-Campbell
2004/0168696 A1 9/2004 Cox
2004/0173233 A1 9/2004 Tokko
2004/0211436 A1 10/2004 Knight
2005/0061341 A1 3/2005 Choe
2005/0098190 A1 5/2005 Kim
2005/0098191 A1 5/2005 Frazier
2005/0115581 A1 6/2005 Choi
2005/0166939 A1 8/2005 Stroud
2005/0194015 A1 9/2005 Watts
2005/0247326 A1 11/2005 Park
2005/0252517 A1 11/2005 Salinas
2005/0252518 A1 11/2005 Salinas
2006/0028040 A1 2/2006 Cohen et al.
2006/0065280 A1 3/2006 Cheung
2006/0065281 A1 3/2006 Kim
2006/0081267 A1 4/2006 Kuptiz
2006/0096609 A1 5/2006 Nwokola
2006/0124658 A1 6/2006 Coe
2006/0129187 A1 6/2006 Cho
2006/0142693 A1 6/2006 Kahen
2006/0175853 A1 8/2006 Anderson
2006/0180168 A1 8/2006 Dinnel
2006/0180171 A1 8/2006 Kim
2006/0266376 A1 11/2006 Basso
2007/0023062 A1 2/2007 McKinstry
2007/0050207 A1 3/2007 Merszei
2007/0084749 A1 4/2007 Demelo et al.
2007/0157941 A1 7/2007 Awad
2007/0157944 A1 7/2007 Catron
2007/0172264 A1 7/2007 An
2007/0199571 A1 8/2007 McCulloch
2007/0221240 A1 9/2007 Junsuh Lee
2007/0227550 A1 10/2007 Merszei
2007/0272263 A1 11/2007 Gold
2007/0272264 A1 11/2007 Byrne
2007/0295353 A1 12/2007 Dinh
2008/0017210 A1 1/2008 Eaton
2008/0196732 A1 8/2008 Merszei
2008/0223390 A1 9/2008 Brown
2008/0276949 A1 11/2008 Lee
2008/0283072 A1 11/2008 Sun
2009/0014023 A1 1/2009 Waters
2009/0026676 A1 1/2009 Kurita
2009/0028625 A1 1/2009 Bonneyrat
2009/0071490 A1 3/2009 Sthair
2009/0071492 A1 3/2009 Oh
2009/0178689 A1 7/2009 Navarro
2009/0217936 A1 9/2009 Sato
2009/0217939 A1 9/2009 Rabe
2009/0223534 A1 9/2009 Green
2009/0241973 A1 10/2009 Hampton
2009/0241979 A1 10/2009 Navarro
2009/0250956 A1 10/2009 Resnick
2009/0255547 A1 10/2009 Starks
2009/0266373 A1 10/2009 Kupitz
2009/0266376 A1 10/2009 Beschta
2010/0043816 A1 2/2010 Dix
2010/0065078 A1 3/2010 Reece
2010/0070526 A1 3/2010 Matias
2010/0127228 A1 5/2010 Xie et al.
2010/0170526 A1 7/2010 Nguyen
2011/0079233 A1 4/2011 Cheh
2011/0079235 A1 4/2011 Reed
2011/0079236 A1 4/2011 Lee
2011/0121592 A1 5/2011 Cho
2011/0127228 A1 6/2011 Sagel
2011/0220136 A1 9/2011 Kang
2011/0226274 A1 9/2011 Turner
2011/0240049 A1 10/2011 Kim
2011/0278869 A1 11/2011 Lee
2011/0290271 A1 12/2011 Rabe
2011/0290937 A1 12/2011 Salkeld
2012/0009002 A1 1/2012 Lo et al.
2012/0037177 A1 2/2012 Teater Makinen
2012/0055499 A1 3/2012 Sanbonmatsu
2012/0160258 A1 6/2012 Cruz et al.
2012/0160259 A1 6/2012 Nguyen
2012/0174939 A1 7/2012 Starks
2012/0180804 A1 7/2012 Hochi
2012/0266903 A1 10/2012 Devlin
2012/0305020 A1 12/2012 Byrne
2012/0318290 A1 12/2012 Kim
2013/0019889 A1 1/2013 Palmer-Rogers
2013/0032162 A1 2/2013 Major
2013/0042881 A1 2/2013 Mutchler
2013/0042884 A1 2/2013 Wilkinson
2013/0110032 A1 5/2013 Luzon
2013/0152960 A1 6/2013 Pays et al.
2013/0160783 A1 6/2013 Ahn
2013/0167855 A1 7/2013 Kupitz

(56) References Cited

U.S. PATENT DOCUMENTS

| | | | |
|---|---|---|---|
| 2013/0167858 | A1 | 7/2013 | Lee |
| 2013/0213431 | A1 | 8/2013 | Geva et al. |
| 2013/0255706 | A1 | 10/2013 | Dinh |
| 2013/0276807 | A1 | 10/2013 | Teater Makinen |
| 2013/0298931 | A1 | 11/2013 | Samain |
| 2013/0306089 | A1 | 11/2013 | Araujo Costa |
| 2013/0306094 | A1 | 11/2013 | West |
| 2013/0312781 | A1 | 11/2013 | Murphy |
| 2013/0312782 | A1 | 11/2013 | Kindall |
| 2013/0320025 | A1 | 12/2013 | Mazzetta |
| 2013/0333714 | A1 | 12/2013 | Merszei |
| 2014/0011372 | A1 | 1/2014 | Kato |
| 2014/0060559 | A1 | 3/2014 | Lin |
| 2014/0069451 | A1 | 3/2014 | Hwang |
| 2014/0083447 | A1 | 3/2014 | Rabe |
| 2014/0110304 | A1 | 4/2014 | Wu |
| 2014/0116456 | A1 | 5/2014 | Palmer-Rogers |
| 2014/0135914 | A1 | 5/2014 | Conant |
| 2014/0216488 | A1 | 8/2014 | Dinh |
| 2014/0332025 | A1 | 11/2014 | Kim |
| 2015/0020840 | A1 | 1/2015 | Rabe |
| 2015/0075549 | A1 | 3/2015 | Lee |
| 2015/0114421 | A1 | 4/2015 | Pham |
| 2015/0114422 | A1 | 4/2015 | Abraham |
| 2015/0114423 | A1 | 4/2015 | Sanbonmatsu |
| 2015/0128986 | A1 | 5/2015 | Stookey |
| 2015/0136162 | A1 | 5/2015 | Brouillet |
| 2015/0173442 | A1 | 6/2015 | Raouf |
| 2015/0181967 | A1 | 7/2015 | Dinh |
| 2015/0181968 | A1 | 7/2015 | Uresti |
| 2015/0201691 | A1 | 7/2015 | Palmer-Rogers |
| 2015/0201692 | A1 | 7/2015 | Hansen |
| 2015/0216246 | A1 | 8/2015 | Ahn |
| 2015/0230884 | A1 | 8/2015 | McDonald et al. |
| 2015/0351467 | A1 | 12/2015 | Simoes |
| 2016/0016702 | A1 | 1/2016 | Siskindovich |
| 2016/0037847 | A1 | 2/2016 | Tavakoli |
| 2016/0037848 | A1 | 2/2016 | Lee |
| 2016/0050996 | A1 | 2/2016 | Kwon |
| 2016/0058088 | A1 | 3/2016 | Le |
| 2016/0088889 | A1 | 3/2016 | Kettavong |
| 2016/0135531 | A1 | 5/2016 | Ezechukwu |
| 2016/0166039 | A1 | 6/2016 | Luu |
| 2016/0174645 | A1 | 6/2016 | Goldner |
| 2016/0192724 | A1 | 7/2016 | Scott |
| 2016/0192725 | A1 | 7/2016 | Merszei |
| 2016/0206031 | A1 | 7/2016 | Stoka |
| 2016/0219959 | A1 | 8/2016 | Chipman |
| 2016/0286881 | A1 | 10/2016 | Ko |
| 2016/0324241 | A2 | 11/2016 | Lee |
| 2016/0324242 | A1 | 11/2016 | Hansen |
| 2016/0345648 | A1 | 12/2016 | Miniello |
| 2016/0353821 | A1 | 12/2016 | Calina |
| 2016/0353861 | A1 | 12/2016 | Carey |
| 2017/0000204 | A1 | 1/2017 | Wibowo |
| 2017/0006947 | A1 | 1/2017 | Uresti |
| 2017/0020219 | A1 | 1/2017 | Beschta |
| 2017/0049172 | A1 | 2/2017 | Ahn |
| 2017/0049173 | A1 | 2/2017 | Dinh |
| 2017/0055615 | A1 | 3/2017 | Crocilla |
| 2017/0079356 | A1 | 3/2017 | Dinh |
| 2017/0079357 | A1 | 3/2017 | Dinh |
| 2017/0079358 | A1 | 3/2017 | Dinh |
| 2017/0112214 | A1 | 4/2017 | Ahn |
| 2017/0112215 | A1 | 4/2017 | Dinh |
| 2017/0112264 | A1 | 4/2017 | Park |
| 2017/0127743 | A1 | 5/2017 | Nakamura |
| 2017/0150763 | A1 | 6/2017 | Schroeder |
| 2017/0208885 | A1 | 7/2017 | Alex |
| 2017/0231309 | A1 | 8/2017 | Han |
| 2017/0258163 | A1 | 9/2017 | Uresti |
| 2017/0265550 | A1 | 9/2017 | Han |
| 2017/0311667 | A1 | 11/2017 | Passariello |
| 2017/0340041 | A1 | 11/2017 | Nguyen |
| 2017/0347731 | A1 | 12/2017 | Chipman |
| 2017/0358245 | A1 | 12/2017 | Dana |
| 2017/0360134 | A1 | 12/2017 | Crocilla |
| 2017/0360135 | A1 | 12/2017 | Ahn |
| 2017/0360136 | A1 | 12/2017 | Ferrier |
| 2018/0065779 | A1 | 3/2018 | Chiba |
| 2018/0098591 | A1 | 4/2018 | Leeflang |
| 2018/0160755 | A1 | 6/2018 | Hansen |
| 2018/0235299 | A1 | 8/2018 | Stoka |
| 2018/0242671 | A1 | 8/2018 | Merszei |
| 2018/0242672 | A1 | 8/2018 | Lotti |
| 2018/0242715 | A1 | 8/2018 | Lotti |
| 2018/0352885 | A1 | 12/2018 | Kim |
| 2018/0352886 | A1 | 12/2018 | Schroeder |
| 2019/0133227 | A1 | 5/2019 | Le |
| 2019/0191851 | A1 | 6/2019 | Esposito |
| 2019/0254373 | A1 | 8/2019 | Kim |
| 2019/0254374 | A1 | 8/2019 | Schroeder |
| 2019/0320772 | A1 | 10/2019 | Dudas |
| 2020/0093211 | A1 | 3/2020 | Lee |
| 2020/0196694 | A1 | 6/2020 | Lotti |
| 2020/0260839 | A1 | 8/2020 | Lotti |
| 2020/0315314 | A1 | 10/2020 | Hantani |
| 2021/0337949 | A1 | 11/2021 | Ardin |

FOREIGN PATENT DOCUMENTS

| | | | | |
|---|---|---|---|---|
| CA | 2928299 | A1 | | 10/2016 |
| CN | 201146962 | Y | | 11/2008 |
| CN | 102355833 | A | | 2/2012 |
| CN | 302315323 | | | 2/2013 |
| CN | 102975141 | A | | 3/2013 |
| CN | 202776481 | U | | 3/2013 |
| CN | 103027410 | A | | 4/2013 |
| CN | 103717108 | A | | 4/2014 |
| CN | 103734961 | A | | 4/2014 |
| CN | 203897379 | U | | 10/2014 |
| CN | 303086463 | | | 1/2015 |
| CN | 104363790 | A | | 2/2015 |
| CN | 204191855 | U | | 3/2015 |
| CN | 205274180 | U | | 6/2016 |
| CN | 304049505 | S | | 2/2017 |
| CN | 304049506 | S | | 2/2017 |
| CN | 106983203 | A | * | 7/2017 |
| CN | 304310042 | S | | 10/2017 |
| CN | 304329374 | S | | 10/2017 |
| CN | 304329375 | S | | 10/2017 |
| CN | 304382151 | S | | 12/2017 |
| CN | 304452297 | | | 1/2018 |
| CN | 304497372 | S | | 2/2018 |
| CN | 207084233 | U | | 3/2018 |
| CN | 304777737 | S | | 8/2018 |
| CN | 304859863 | S | | 10/2018 |
| CN | 304859864 | S | | 10/2018 |
| CN | 305599881 | S | | 2/2020 |
| CN | 305719777 | | | 4/2020 |
| CN | 305729159 | S | | 4/2020 |
| CN | 305738664 | | | 4/2020 |
| DE | 950232 | C | | 10/1956 |
| EP | 1839526 | A1 | | 10/2007 |
| EP | 1839526 | B1 | | 7/2009 |
| FR | 569600 | A | | 4/1924 |
| FR | 1435971 | A | | 4/1966 |
| FR | 1539430 | A | | 9/1968 |
| FR | 2785514 | A1 | | 5/2000 |
| FR | 2897760 | A1 | | 8/2007 |
| GB | 190218723 | A | | 11/1902 |
| GB | 102106 | A | | 11/1916 |
| GB | 1021063 | A | * | 2/1966 |
| GB | 1042020 | A | | 9/1966 |
| GB | 1263815 | A | | 2/1972 |
| GB | 1272616 | A | | 5/1972 |
| GB | 1307107 | A | | 2/1973 |
| GB | 2369712 | B | | 3/2004 |
| GB | 2450250 | A | | 12/2008 |
| GB | 2458230 | A | | 9/2009 |
| GB | 2458230 | B | | 5/2010 |
| GB | 2516622 | A | | 2/2015 |
| GB | 6024289 | | | 12/2017 |
| JP | S471395 | U | | 8/1972 |

(56) References Cited

FOREIGN PATENT DOCUMENTS

| | | | |
|---|---|---|---|
| JP | S4721880 | U | 11/1972 |
| JP | S484711 | U | 1/1973 |
| JP | S484711 | Y1 | 2/1973 |
| JP | S486937 | Y1 | 2/1973 |
| JP | 48007948 | B | 3/1973 |
| JP | S4833591 | U | 4/1973 |
| JP | S4993157 | A | 9/1974 |
| JP | S5383862 | A | 7/1978 |
| JP | 3101488 | U | 6/2004 |
| JP | 2007222271 | A | 9/2007 |
| JP | 2008297690 | A | 12/2008 |
| JP | 2009040718 | A | 2/2009 |
| JP | 3155628 | U | 11/2009 |
| JP | 3157680 | U | 2/2010 |
| JP | 2010099141 | A | 5/2010 |
| JP | 2010137329 | A | 6/2010 |
| JP | 2011106066 | A | 6/2011 |
| JP | 2011122288 | A | 6/2011 |
| JP | 3170596 | U | 9/2011 |
| JP | 2011177395 | A | 9/2011 |
| JP | 3175232 | U | 4/2012 |
| JP | 2015105447 | A | 6/2015 |
| JP | 5823118 | B2 | 11/2015 |
| JP | 3201846 | U | 1/2016 |
| JP | 2016027220 | A | 2/2016 |
| JP | 5955355 | B2 | 7/2016 |
| JP | 2016163699 | A | 9/2016 |
| JP | 2017012047 | A | 1/2017 |
| JP | 6130571 | B1 | 5/2017 |
| JP | 2018076626 | A | 5/2018 |
| JP | 2019044277 | A | 3/2019 |
| JP | 2019063975 | A | 4/2019 |
| JP | 2019094588 | A | 6/2019 |
| KR | 200165452 | Y1 | 2/2000 |
| KR | 200171517 | Y1 | 3/2000 |
| KR | 200240234 | Y1 | 10/2001 |
| KR | 200260653 | Y1 | 1/2002 |
| KR | 20020065306 | A | 8/2002 |
| KR | 200350229 | Y1 | 5/2004 |
| KR | 100450341 | B1 | 10/2004 |
| KR | 200367525 | Y1 | 11/2004 |
| KR | 200369937 | Y1 | 12/2004 |
| KR | 200394275 | Y1 | 9/2005 |
| KR | 200395554 | Y1 | 9/2005 |
| KR | 20060010717 | A | 2/2006 |
| KR | 200439673 | Y1 | 4/2008 |
| KR | 20090010717 | A | 1/2009 |
| KR | 20090010717 | U | 10/2009 |
| KR | 20100112249 | A | 10/2010 |
| KR | 20110113819 | A | 10/2011 |
| KR | 101234507 | B1 | 2/2013 |
| KR | 20130082427 | A | 7/2013 |
| KR | 101336422 | B1 | 12/2013 |
| KR | 101392845 | B1 | 5/2014 |
| KR | 101396272 | B1 | 5/2014 |
| KR | 101509029 | B1 | 4/2015 |
| KR | 20150033455 | A * | 4/2015 |
| KR | 101566166 | B1 | 11/2015 |
| KR | 20160090493 | A | 8/2016 |
| KR | 300906653 | | 5/2017 |
| KR | 101829167 | B1 | 2/2018 |
| KR | 20200127191 | A | 11/2020 |
| PL | 230008 | B1 | 9/2018 |
| RU | 2417719 | C1 | 5/2011 |
| RU | 2419364 | C2 | 5/2011 |
| RU | 2558482 | C1 | 8/2015 |
| RU | 156273 | U1 | 11/2015 |
| RU | 2576010 | C2 | 2/2016 |
| TR | 201200188 | U | 2/2012 |
| TW | M388245 | U | 9/2010 |
| TW | M430199 | U | 6/2012 |
| TW | M476490 | U | 4/2014 |
| TW | 201519805 | A | 6/2015 |
| TW | M537837 | U | 3/2017 |
| TW | M541752 | U | 5/2017 |
| WO | 2007138289 | A1 | 12/2007 |
| WO | 2008140152 | A1 | 11/2008 |
| WO | 2009082098 | A2 | 7/2009 |
| WO | 2012026315 | A1 | 3/2012 |
| WO | 2014029935 | A1 | 2/2014 |
| WO | 2014139943 | A1 | 9/2014 |
| WO | 2014163364 | A1 | 10/2014 |
| WO | 2015116246 | A1 | 8/2015 |
| WO | 2015190845 | A1 | 12/2015 |
| WO | 2017086254 | A1 | 5/2017 |
| WO | 2018002914 | A1 | 1/2018 |
| WO | 2020082056 | A1 | 4/2020 |
| WO | 2020082058 | A1 | 4/2020 |

OTHER PUBLICATIONS

Machine Translation Kim (Year: 2015).*

Allure: "Lashify False Lashes Review," Published By Sable Yong, Oct. 10, 2018, 9 Pages, Site Visited Feb. 17, 2021, Retrieved from URL: https://www.allure.com/story/lashify-false-eyelashes-review-photos.

Amazon: "6 Pieces Eyelash Packaging Cirle Box with Mirror, Eyelash Storage Box Empty Lash Case with Lash Holder for Women Girls (Rose Gold)," Maitys, Amazon.com, Jun. 23, 2020, 1996-2021, pp. 1-8, Site visited Oct. 25, 2021, Retrieved from URL: https://www.amazon.co.uk/piece-Eyelash-Packaging-Circle-Storage/dp/B08BNZ5GQQth=1.

Amazon: "Alessi Yoyo Pill Box, Published by Michel Bouquillon," Nov. 20, 2018, 9 Pages, Site Visted Aug. 6, 2020, Retrieved from URL: https://www.amazon.com/Alessi-Stainless-Steel-Michel-Bouquillon/dp/B07KKFQNQ6.

Amazon: "Eyelash Applicator Tool By: Lasnten," Mar. 2, 2022, 1 Page, [Retrieved on Nov. 14, 2023] Retrieved from [https://www.amazon.com/Lasnten-Applicator-Tweezers-Extensions-Stainless/dp/B0CG9DDLTN?th=1].

Amazon: "Kiss I-Envy Premium Quattro 01 Lashes," 3 Pages, [Retrieved on Dec. 30, 2020] Retrieved from URL: https://www.amazon.ca/Kiss-ienvy-quattro-Makeup-Count/dp/B016SKJJKM.

Amazon: "Kiss I-Envy Quattro 02 Lashes, Pack of 3," 5 Pages, [Retrieved on Dec. 30, 2020] Retrieved from URL: https://www.amazon.com/iEnvy-Kiss-Quattro-Lashes-Pack/dp/B01706J2FG.

Amazon: "Kiss I-Envy Quattro Lashes 01, Pack of 3," 5 Pages, [Retrieved on Dec. 30, 2020] Retrieved from URL: https://www.amazon.com/iEnvy-Kiss-Quattro-Lashes-Pack/dp/B06XGBTCHW.

Amazon: "Kiss I-Envy Trio Medium Lashes 30 Trio Lashes (2 Pack)," 7 Pages, [Retrieved on Mar. 9, 2021] Retrieved from URL: https://www.amazon.com/Kiss-Envy-Trio-Medium-Lashes/dp/B018JORMXU.

Amazon: "Kiss I-Envy Ultra Black Trio Medium Lashes KPEC02UB (2 Pack)," 7 Pages, [Retrieved on Mar. 9, 2021] Retrieved from URL: https://www.amazon.com/Kiss-Envy-Ultra-Black-Medium/dp/B00W2C4HPS?th=1.

Amazon: "Lashview Vetus Angled Pointed Perfect Craft Fine Angled Removal Stainless Steel Tip Curved Tweezers for Professional Grafting Eyelash Extension False Eyelash Nail Art Electionics Medical," By Lashview Vetus, Found on Amazon on Apr. 15, 2021, 1 Page, Retrieved from URL: https://www.amazon.com/dp/B01M4KQOCH/ref=sspa_dk_detail_0psc=1&pd_rd_i= Mar. 22, 2018.

Amazon: "Leteveri Eyelash Applicator Tool—35mm Width False Eyelash Tool with Silicone Clip Design, 2PCS Eyelash Tweezers for False Lashes," Oct. 12, 2022, 1 Page, [Retrieved on Mar. 10, 2023] Retrieved from URL: https://www.amazon.com/Leteveri-Eyelash-Applicator-Tool-Silicone/dp/B0BM5QYC1F/ref=sr_1_3?crid=3SMPJ51ZRAT4N&keywords=.

Amazon: "Ocamo False Eyelashes Curler Stainless Steel Extension Eye Lash Applicator Remover Tweezers Clip Makeup Tools," 3 Pages, [Retrieved on Oct. 10, 2018] Retrieved from URL: https://www.amazon.kin/Ocamo-Eyelashes-Stanless-Extension-Applicator/dp/B07FT5XW8C?ag=googinhydr18418-21&tag=googinkenshoo-21&ascsu.

(56) References Cited

OTHER PUBLICATIONS amazon.com: "Kiss Ever Ez Lahes 30 Count Trio Lashes in Various Lengths 57927: Beauty," 8 Pages, [Retrieved on Mar. 9, 2021] Retrieved from URL: https://www.amazon.com/kiss-Lahes-Lashes-Various-Lengths/dp/B00JH7SR4S.
Ammancart: "Kiss I-Envy Premium Quattro 01 Lashes," 2 Pages, [Retrieved on Dec. 30, 2020] Retrieved from URL: https://www.ammancart.com/products/kiss-i-envy-premium-quattro-01-ashes-kpe62.
Beautylicious: "Kiss I-Envy Pre-Cut Lashes," 4 Pages, [Retrieved on Dec. 30, 2020] Retrieved from URL: https://www.shopbeautylicious.com/products/kiss-i-envy-pre-cut-lashes.
Beautyproducstusa: "Kiss I-Envy Premium Quattro 01 Lashes," 2 Pages, [Retrieved on Dec. 30, 2020] Retrieved from URL: https://www.beautyproductsusa.com/home/322-kiss-i-envy-strip-eyelash-quattro-01-kpe62.html.
Bicoastal Beauti: "Kiss i-Envy Premium Quattro 01 Lashes (KPE62), " 3 Pages, [Retrieved on Dec. 30, 2020] Retrieved from URL: https://www.bicoastalbeauti.com/shop/kiss-brand-lashes/kiss-i-envy-premium-quattro/.
Bilobeauty: "Kiss I-Envy Premium Quattro 01 Lashes," 2 Pages, [Retrieved on Dec. 30, 2020] Retrieved from URL: https://www.biloltd.net/product-p/60351.html.
BL Lashes: "Your Guide to Russian vol. Lash Extensions," 10 Pages, [Retrieved on Mar. 29, 2023] Retrieved from URL: https://www.bllashes.com/blogs/blog/your-guide-to-the-must-have-tools-for-russian-volume-lashes.
Born Pretty: "False Eyelashes Thick Natural Simulation Recyclable Curly False Eyelash Makeup Cosmetic Tools," 6 Pages, [Retrieved on Oct. 18, 2018] Retrieved from URL: http://www.bornprettystore.com/false-eyelashes-thick-natural-simulation-recyclable-curly-false-eyelash-makeup-cosmetic-tools-p-44675.
Brandrup J., et al., "Polymer Data Handbook," 1999, New York: Wiley, Edited by James E. Mark, vol. 89, 7 Pages.
Buykorea: "Plastic, False Eyelash Applicator, Multy colour," Tweed K Inc., pp. 1-3, [Retrieved on Feb. 14, 2019] Retrieved from URL: http://www.buykorea.or.kr/product-details/Plastic-False-Eyelash-Applicator-Multy-colour-3106709.html.
Canadian Patent Application No. 3206108, Office Action dated Apr. 17, 2024.
Cashmere Cosmetics: "Kiss I-Envy Premium Quattro 01 Lashes," 4 Pages, [Retrieved on Dec. 30, 2020] Retrieved from URL: https://www.cashmerecosmetics.com/product/kiss-i-envy-quattro-01-lashes/.
Delicate Hummingbird: "Ha! I've Mastered the False Lashes!," Nov. 10, 2011, 12 Pages, Retrieved from URL: http://delicatehummingbird.blogspot.com/2011/11/ha-ive-mastered-false-lashes.html.
Ebay: "BL Kiss I Envy Quattro 01 Lashes—Two Pack," 4 Pages, [Retrieved on Dec. 30, 2020] Retrieved from URL: https://www.ebay.ca/itm/BL-Kiss-I-Envy-Quattro-01-Lashes-Two-PACK-/293706028541.
Ebay: "lenvy," 23 Pages, [Retrieved on Dec. 30, 2020] Retrieved from URL: https://www.ebay.eom/sch/i.html_nkw=lenvy&norover=1&mkevt=1mkrid=711-156598-701868-2&mkcid=2&keyword=ienvy&crip=435059434779.
Ebay: "Kiss Ever EZ Trio Lashes Medium Combo 30 EA 2pk," [Retrieved on Mar. 9, 2021] Retrieved from URL: https://www.ebay.com/urw/Kiss-Ever-EZ-Trio-Lashes-Medium-Dombo-30-EA-2pk/product-reviews/1117964400?pgn=2#.
Ebay: "Kiss I-Envy Premium Quattro 01 Lashes," 3 Pages, [Retrieved on Dec. 30, 2020] Retrieved from URL: https://www.ebay.eom/p/1044019861.
Ebay: "Kiss I-Envy Strip Eyelashes—Pack of 2 (Choose Your Style)," 2 Pages, [Retrieved on Dec. 30, 2020] Retrieved from URL: https://www.ebay.com.au/itm/Kiss-I-Envy-Strip-Eyelashes-Pack-of-2-Choose-your-Style/1 83303124469.
Ebnesajjad S., et al., "Classification of Adhesives and Compounds," Adhesives technology handbook, Nov. 26, 2014, pp. 67-83.
Electron Microscopy Sciences: "EMS High Precisions and Ultra Fine Tweezers," Feb. 13, 2019, 7 Pages, Retrieved from URL: https://www.emsdiasum.com/microscopy/products/tweezers/ultra_fine.aspx.
Extended European Search Report for European Application No. 17835287.8, mailed Feb. 11, 2020, 05 Pages.
Extended European Search Report for European Application No. 17884561.6, mailed Sep. 11, 2020, 8 Pages.
Extended European Search Report for European Application No. 19873364.4, mailed Jun. 15, 2022, 10 Pages.
Extended European Search Report for European Application No. 19874123.3, mailed Jun. 21, 2022, 8 Pages.
Extended European Search Report for European Application No. 20741513.4, mailed Oct. 21, 2022, 9 Pages.
Extended European Search Report for European Application No. 20741939.1, mailed Sep. 9, 2022, 8 Pages.
Extended European Search Report for European Application No. 21185294.2, mailed Oct. 11, 2021, 9 Pages.
Extended European Search Report for European Application No. 22211037.1, mailed Mar. 7, 2023, 6 Pages.
Eyelash applicator tool By Leteveri found on Amazon (Dec. 14, 2023), https://www.amazon.com/Leteveri-Eyelash-Applicator-Tool-Silicone/dp/B0BM5QYC1F/ref=sr_1_3crid=3SMPJ51ZRAT4N&keywords (Oct. 12, 2022).
Facebook: "Avant Garde Beauty, Eyelash Holder," Aug. 12, 2020, 2 Pages, Eyelash Holder, Site Visited Oct. 5, 2022, Retrieved from URL: https://www.facebook.com/photo/fbid=162270508866790&set=a.161502768943564.
Falscara By: "The New Line of Kiss Lashes," Kiss, 2021, 1 Page, Found online on [Apr. 7, 2023] Retrieved From URL: https://www.youtube.com/watch?v=cQfRFdZa1zE&t=2s.
False Eyelashes: "False Eyelashes 101 Tip: How (and Why) to Layer False Eyelashes," May 2, 2012, 11 Pages, Retrieved from URL: https://elegantlashesblog.wordpress.com/2012/05/02/false-eyelashes-101-tip-how-and-why-to-layer-false-eyelashes/.
First Office Action for Chinese Application No. 201780004312.1, mailed May 7, 2020, 17 Pages.
First Office Action for Chinese Application No. 201780033755.3, mailed Aug. 28, 2020, 8 Pages.
Focallure: "Eyelash Tweezer Applicator By ILash," Shopfocallure, Feb. 14, 2019, 1 Page, Retrieved from URL: https://shopfocallure.com/collections/eyelashes/products/eyelash-tweezer-by-focallure.
Glad Girl: "Glad Lash Flare Cluster Lash Application," Jan. 31, 2014, 49 Pages, Retrieved from URL: https://www.youtube.com/watch?v=JU_ZcY95nVo&t=23s.
Hollyren: "Diy Eyelash Extensions Superfine Band Cluster Lashes Kit," 3 Pages, [Retrieved on Feb. 5, 2021] Retrieved from URL: https://www.hollyren.com/DIY-Eyelash-Extensions-Superfine-Band-Cluster-Lashes-Kit_7740.html.
Hollyren: "OEM Eyelash Applicator By: Hollyren," Apr. 7, 2023, 1 Page, Retrieved from URL: https://www.hollyren.com/ProDetail/Oem%20eyelash%20applicator.
Youtube: "Artificial Eyelashes (1949)," Apr. 13, 2014, 87 Pages, Retrieved from URL: https://www.youtube.com/watch?v=8Fv7EzDvo58.
Youtube: "Bella Lash Diamond Elite Tweezers," Jul. 11, 2016, 36 pages, [Downloaded on Mar. 28, 2024] Retrieved from [URL: https://www.youtube.com/watch?v=yWB4YR6CKYc].
Youtube: "Crazy False Eyelash Hack For Natural Comfortable Lashes," 2017, 31 Pages, Retrieved from URL: https://www.youtube.com/watch?v=99rHNYe3GFw.
Youtube: "Deyeko—Olga Lydia Factory Visit," Jun. 24, 2013, 47 Pages, Retrieved from URL: https://www.youtube.com/watch?v=Q5ZLklqkEtY.
Youtube: "Dream Lashes Curved vol. Tweezer—3 Minute Test," Sep. 30, 2016, 1.15-1.30, 1 Page [Downloaded on Feb. 13, 2019] Retrieved from URL: https://www.youtube.com/watch?v:vwqYeE0SD7s.
Youtube: "Eyelash Extensions: Self Eyelashes," 2 pages, [Retrieved on Sep. 17, 2014], Retrieved from [https://www.youtube.com/watch?v=gfoGzBwvcnE].

(56) References Cited

OTHER PUBLICATIONS

Youtube: "False Lashes Tips And Tricks For Beginners, The How to Guide for Lashes," Jan. 27, 2017, 36 Pages, Retrieved from URL: https://www.youtubecom/watchv=BaQO8g4iUxY.
Youtube: "Falsecara By: Kiss," Jan. 2, 2021, 1 Page, [Retrieved on Nov. 14, 2023] Retrieved from [URL:https://www.kissusa.com/products/falscara-starter-kit-diy-lash-extensions].
Youtube: "FalseLashes, Falscara By: Kiss," Dec. 23, 2019, 1 Page, [Retrieved on Apr. 4, 2023] Retrieved from URL: https://www.youtube.com/watch?v=cQfRFdZa1zE.
Youtube: "Goodyard Eyelash Production Process," Goodyardhair Factory, 2016, 57 Pages, Retrieved from URL: https://www.youtube.com/watch?v=FlxGtTPNALo.
Youtube: "How False Eyelashes Are Made," Nov. 29, 2015, 69 Pages, Retrieved from URL: https://www.youtube.com/watch/=hqsxokthwqg.
Youtube: "How to : Master Applying False Eyelashes," Jan. 23, 2014, 137 pages, [Downloaded on Mar. 28, 2024] Retrieved from [URL: https://www.youtube.com/watch?v=rtX7pZgiJe8].
Youtube: "How to Apply Cluster Party Lashes 2," Feb. 12, 2014, 43 Pages, Retrieved from URL: https://www.youtube.com/watch?v=faKvACCAvNU.
Youtube: "How to apply Cluster/Party Lashes 2," Feb. 12, 2014, 79 pages, [Downloaded on Mar. 28, 2024] Retrieved from [URL: https://www.youtube.com/watch?v=faKvACCAvNU].
Youtube: "How To Apply False Eyelashes For Beginners Two Easy Ways," Sep. 6, 2013, 29 Pages, Retrieved from URL: https://www.youtube.com/watch?app=desktop&v=79oS17fNzOE.
Youtube: "How To Apply False Lashes . . . Underneath!?," Jan. 13, 2017, 66 Pages, Retrieved from URL: https://www.youtube.com/watch?v=mlkvFgb8PmA.
Youtube: "How To Apply False Lashes Under Your Lashes Reverse Eyelash Trick Makeup Hack," 2016, 40 Pages, Retrieved from URL: https://www.youtube.com/watch?v=BCq4xCQrQHE.
Youtube: "How to Apply iENVY Quattro Collection Eyelashes," Aug. 18, 2015, 14 Pages, Retrieved from URL: https://www.youtube.com/watch?v=kW-ovlGoCmc.
Youtube: "How To Apply Individual False Lashes—Lashes Love & Leather," 2016, 24 Pages, Retrieved from URL: https://www.youtube.com/watch?v=nLMz-lauMkl.
Youtube: "How to Apply Individual Lashes," Apr. 5, 2010, 77 Pages, Retrieved from URL: https://www.youtube.com/watch?v=9X84CUIWqgo.
Youtube: "How to Apply Individual Lashes," Mar. 16, 2013, 77 Pages, Retrieved from URL: https://www.youtube.com/watch?v=aLHE2SqzlO8.
Youtube: "How To Apply Individual Lashes ft. Ardell Individuals | Melissa Alatorre," 2015, 46 Pages, Retrieved from URL: https://www.youtube.com/watchv=c2iqLwjryWM.
Youtube: "How to Apply Lashes Using Sephora Bull Eye Lash Applicator," Nov. 14, 2012, 32 Pages, Retrieved from URL: https://www.youtube.com/watch?v=yYwcYzXJX4M.
Youtube: "How To Fake Eyelash Extensions Reviewing Kiss Ever EZ Lashes," 2015, 40 Pages, Retrieved from URL: https://www.youtube.com/watch?v=AhJyTcClaMs.
Youtube: "How To Master Individual Fake Eyelashes NewBeauty Tips & Tutorials," Aug. 21, 2015, 56 Pages, Retrieved from URL: https://www.youtube.com/watch?v=ObltZN1NsB0&t=44s.
Youtube: "In Depth Tutorial Ardell Lashtite Glue Apply Under My Natural Lashes," Feb. 24, 2015, 40 Pages, Retrieved from URL: https://www.youtube.com/watch?v=comq0clt56o.
Youtube: "Introducing Kiss EverEZ Trio Lashes," May 10, 2013, 47 Pages, Retrieved from URL: https://www.youtube.com/watch?v=37z4VMQ7Yxc.
Youtube: "Introducing: ProComfort Ceramic Angled Tweezer," Aug. 29, 2014, 13 pages, [Downloaded on Mar. 28, 2024] Retrieved from [URL: https://www.youtube.com/watch?v=oAHGR_Y8mvk].
Youtube: "Lisa Eldridge—How To Apply Individual False Eyelashes Tutorial," Youtube, Mar. 17, 2010, 45 Pages, Retrieved from URL: https://www.youtube.com/watch?v=IKO10VdtLFU.
Youtube: "Solving the Oval Office Puzzle Box," Puzzle Master Incorporated, Published by PuzzleOZ, Jun. 4, 2017, 7 Pages, Site Vistied May 17, 2019, Retrieved from URL: https://www.youtube.com/watchv=wzZCm9sUU7E.
Youtube: "Process of Making False Eyelash Product," Lux Beauty Lashes, Dec. 12, 2015, 53 Pages, Retrieved from URL: https://www.youtube.com/ watchv=515QCxnjrkQ.
Youtube: "Process of Making Mellow Eyelashes," Nov. 12, 2015, 60 pages, [Downloaded on Mar. 28, 2024] Retrieved from [URL: https://www.youtube.com/watch?v=-VlhGQX58HM].
Youtube: "Reverse Eyelash Hack: Does it work?," Oct. 12, 2016, 75 Pages, Retrieved from URL: https://www.youtube.com/watch?v=sx_X89xdBbE.
Youtube: "Reverse Eyelash Trick Makeup Hack," Sep. 18, 2016, 55 Pages, Retrieved from URL: https://www.youtube.com/watch?/=FQFF1sOQbCl.
Youtube: "Reverse Eyelash Tutorial-Irisbeilin," Sep. 13, 2016, 20 Pages, Retrieved from URL: https://www.youtube.com/watch/=q1Cu0p6bqHs.
Youtube: "Review New Kiss I Envy EZ Lashes Trio Lashes—Easier Than Individual Lashes," Mar. 10, 2021, 47 Pages, Retrieved from URL: https:// www.youtube.com/watch?v=BS9G6jgDgOA.
Youtube: "The Best Way to Apply False Lashes," Cosmopolitan, Apr. 1, 2016, 4 Pages, Retrieved from URL: https://www.youtube.com/watch?/=40yZu-4KZs8.
Youtube: "Trio Lashes Are So In Right Now | Ever EZ Lashes By Kiss," Feb. 20, 2015, 43 Pages, Retrieved from URL: https://www.youtube.com/watch?v=bx6PXgZMvhg.
Youtube: "Volume Tweezers," Jun. 11, 2014, 20 Pages, Retrieved from URL: https://www.youtube.com/watchv=vvbDF18x2h8.
Office Action for Japanese Patent Application No. 2022520667, mailed Dec. 7, 2023, 02 Pages.
Office Action for Japanese Patent Application No. 2023112532, mailed Feb. 26, 2024, 01 Page.
Office Action for Japanese Patent Application No. JP2023-014624, mailed Dec. 18, 2023, 7 Pages.
Office Action for Korean Patent Application No. 10-2021-7043383, mailed Feb. 26, 2024, 06 Pages.
Office Action for Singapore Application No. 10202106633V, mailed Feb. 27, 2024, 06 Pages.
Pak Lajpall: "Nail Artist Tweezers PL-1," 1 Page, [Retrieved on Feb. 13, 2019], Retrieved from URL: http://www.laipall.com/proddetail.prod=nail-artists-tweezers1.
Palin G.R., "Plastics for Engineers: An Introductory Course," Chapter 13, Thermosetting Plastics, Elsevier, 1967, pp. 125-139.
Patent Trial and Appeal Board (PTAB), PGR2021-00045, *Kiss Nail Products Incorporated* (Petitioner) v. *Lashify Incorporated* (Patent Owner).
Patent Trial and Appeal Board (PTAB), PGR2021-00046, *Kiss Nail Product Incorporated* v. *Lashify Incorporated* (Patent Owner).
Peonies and Lilies: "Bourjois 2 in 1 Tweezers and Faux Fabulous Eyelashes," Beauty, Lifestyle, Travel, Oct. 24, 2012, 2 Pages.
Picclick: "I-Envy By Kiss So Wispy #01 Strip Eyelashes KPE58 False Lashes Black 1 Pair New," Dec. 30, 2020, 8 Pages, Retrieved from URL: https://www.picclickimg.com/d/w1600/pict/292311410878_/i-ENVY-by-Kiss-SO-WISPY-01-Strip-Eyelashes.jpg.
Pinterest: "How to Apply iENVY Quattro Collection Eyelashes," Dec. 30, 2020, 14 Pages, [Retrieved on Mar. 31, 2023] Retrieved from URL: https://www.pinterest.com/pin/43347215141316080/.
Pinterest: "Kiss Bring the Salon Home," 2 Pages, [Retrieved on Dec. 30, 2020] Retrieved from URL: https://www.pinterest.com.au/pin/19562579608263895/.
Pinterest: "Kiss I-Envy 100% Human Eyelash So Wispy 03," 3 Pages, [Retrieved on Dec. 30, 2020] Retrieved from URL: ; https://www.pinterest.co.kr/pin/308285536984155041/.
Pinterest: "Kiss I-Envy by Kiss 100% Human Pre Cut Eyelash Quattro 02 Lashes," 2 Pages, [Retrieved on Dec. 30, 2020] Retrieved from URL: https://www.pinterest.cl/pin/576038608568497288/amp_client_id=CLIENT_ID(_J&mweb_unauth_id=&from_amp_pin_page=true.

(56) References Cited

OTHER PUBLICATIONS

Pinterest: "Kiss Premium Lashes, I-Envy by Kiss Premium Lashes," 2 Pages, [Retrieved on Dec. 30, 2020] Retrieved from URL: https://www.pinterest.es/amp/pin/449515606533816815/.
Qingdao Hongfutian Eyelash Co., Ltd., Youtube, Oct. 13, 2016, 21 Pages, Retrieved from URL: https://www.youtube.com/watch?v=rlnKgJJm7-0.
Rich., "Buzludzha Monument, Gueorguy Stoilov Circa," Justanotherbackpacker.com, Apr. 29, 2014, 10 Pages, Site Visited on Aug. 27, 2019, Retrieved from URL: http://www.justanotherbackpacker.com/buzludzha-monument-bulgaria-ufo/.
Rodulfo K., "This DIY Lash Extension Kit Has Ruined Mascara for Me Forever," Elle, May 16, 2018, 6 Pages, [Retrieved on Dec. 31, 2018] Retrieved from URL: https://www.elle.com/beauty/makeup-skin-care/a20704236/lashify-lashes-kit-review/.
Rosato M.G., et al., "Basics and Overviews of Plastics Fabricating Processes," Springer Science Business Media, New York, 2000, pp. 39-52.
Satkowski M.M., "The Crystallization and Morphology of Polyethylene and its Blends," Doctoral Dissertations 1896—Feb. 2014, Jan. 1, 1990, 4 Pages.
Search Report and Written Opinion for Singapore Application No. 10202106633V, dated Jan. 21, 2022, 13 Pages.
Shopee: "Tweezer Applicator for False Fake Eyelash Eye Lash Lashes Falsies Cosmetic Tool," Jul. 14, 2019, 1 Page, [Retrieved on Oct. 14, 2022] Retrieved from URL: https://shopee.ph/Tweezer-Applicator-For-False-Fake-Eyelash-Eye-Lash-Lashes-Falsies-Cosmetic-Tool-i.63392971.1750684108.
Shopee: "Vetus Tweezers, Anti Static Non-Magnetic, High Precision Stainless Steel Tweezer Tool," Aug. 10, 2021, 1 Page, [Retrieved on Oct. 14, 2022] Retrieved from URL: https://shopee.com.my/VETUS-Tweezers-Anti-Static-Non-Magnetic-High-Precision-Stainless-Steel-Tweezer-Tool-i.183308257.783935374.
Siegmann A., et al., "Melting and Crystallization of Poly (Ethylene Terephthalate) under Pressure," Journal of Polymer Science: Polymer Physics Edition, 1980, vol. 18 (11), pp. 2181-2196.
Silmy's Eyelashes, Youtube, 2011, 11 Pages, Retrieved from URL: https://www.youtube.com/watch?v=l_rg1ybHUwY.
Staar Alert: "Locking Automated Medication Dispenser," Starralert.com, WayBack Machine, Staar Altelt, Aug. 14, 2020, 4 Pages, [Retrieved online on Feb. 19, 2021] Retrieved from URL: https://www.staaralert.com/locking-medication-dispenser.
"The Small Things, How to Fake a Thicker Lash Line,"May 17, 2017, Retrieved from URL: https://www.thesmallthingsblog.com/2016/05/how-to-Fake-a-thicker-lash-lme/#:text=Pick%20up%20a%20gel%20orof%20a%20thicker%20lash%20lme.
The Sunday Girl: "Bourjois-2-in-1 Tweezers and False Eyelash Applicator Review," Nov. 5, 2012, 1 Page, [Retrieved on Apr. 13, 2021] Retrieved from URL: http://www.thesundaygirl.com/2012/11/bourjois-2-in-1-tweezers-and-false.html.
Troughton M.J., et al., "Handbook of Plastics Joining: A Practical Guide," 2nd Edition, William Andrew Incorporated, Oct. 17, 2008, 25 Pages.
Tweezers: "Eyelash Tweezers—Feita Precision Eyelash Extension Tweezers Set-Professional Straight Curved Pointed Very Fine Tip Tweezers for Lash Extensions—Black-2Pcs," Reviewed on Dec. 13, 2016 on Amazon.com, 30 Pages, [Retrieved on Dec. 31, 2018] Retrieved from URL: https://www.amazon.com/Eyelash-Tweezers-Precision-Extension-Professional/dp/B01I2KSUDSth=1.
Ubuy: "I-Envy by Kiss Premium Quattro 02 Lashes," Dec. 30, 2020, 3 Pages, Retrieved from URL: https://www.ubuy.com.kw/en-sa/catalog/product/view/id/37236.
United Beauty Supply: "Kiss I-Envy Trio Lashes Ultra Volume Kpec—3X Volume," 7 Pages, [Retrieved on Mar. 9, 2021] Retrieved from URL: https://www.unitedbeautysupply.com/product/kiss-i-envy-trio-lashes-ultra- /olume-kpec/.
United States District Court District of California San Francisco Division, 3:20-cv-06086, *Lashify Incorporated* v. *Alicia Zeng and Patrick Ellsworth d/b/a Lilac St; and Artemis Family Beginnings Incorporated*.
United States District Court District of New Jersey, 2:20-cv-10023-JMV-MF, *Lashify Incorporated* v. *Kiss Nail Products Incorporated*.
U.S.Salonsupply: "Kiss I-Envy Premium Quattro 01 Lashes," 2 Pages, [Retrieved on Dec. 30, 2020] Retrieved from URL: https://www.ussalonsupply.com/Kiss-I-Envy-Quattro-01-Lashes-p_120305.html.
Varga J., et al., "Vibration Welding of Alpha and Beta Isotactic Polypropylenes: Mechanical Properties and structure," Express Polymer Letters, Mar. 1, 2008, vol. 2, No. 3, pp. 5-19.
Versionone S., "Cruiser Portable Speaker," NYNE, Published at thegamerwithkids.com, Posted on Apr. 6, 2015, not listed, [Cite Visited Jun. 20, 2018],3 Pages, Retrieved from URL: https://thegamerwithkids.com/2015/04/06/nyne-cruiser-review-a-wireless-speaker-for-your-bycicle/.
Walmart: "Kiss I-Envy by Kiss Premium Quattro 02 Lashes," 8 Pages, [Retrieved on Dec. 30, 2020] Retrieved from URL: https://www.walmart.com/ip/Kiss-I-Envy-Quattro-02- Lashes/187353459.
Web: "Best Tweezers—Ergonomic Products," The Wayback Machine, Feb. 14, 2014, 02 pages, [Downloaded on Mar. 28, 2024] Retrieved from [URL: https://web.archive.org/web/20120214160346/ http://www.beauty2makeup.com:80/blog/best-tweezers/].
Web: "Diamond Elite Tweezer—Main," Embellashes, Feb. 20, 2024, 03 pages, [Downloaded on Mar. 28, 2024] Retrieved from [URL: https://embellashes.com/product/diamond-elite-tweezer-2/].
Web: "Eyelash Extensions Tweezer," Shine Beauty Group, Feb. 20, 2024, 06 pages, [Downloaded on Mar. 28, 2024] Retrieved from [URL: https://www.shinebeautygroup.com/eyelash-extension-products/p/diamond-elite-tweezers-1].
Web: "ProComfort Ceramic Angled Lash Extensions Tweezer," Xtreme Lashes, Feb. 20, 2024, 03 pages, [Downloaded on Mar. 28, 2024] Retrieved from [URL: https://www.xtremelashes.com/tweezers-and-tools/procomfort-ceramic-angled-tweezer?selection=&gad_source=1&gclid=EAlalQobChMl34KCotq4hA . . . ].
"Why Tightlining is the Makeup Trick you Need to Try," Get The Gloss, May 6, 2016, 6 Pages, Retrieved from URL: https://www.getthegloss.com/beauty/makeup/why-tightlining-is-the-makeup-trick-you-need-to-try.
Youtube: "All About Eyelash Extensions! FAQ's Application FAQ's SaturdayNightsAlrite," 2013, 175 Pages, Retrieved from URL: https://www.youtube.com/watch?v=MTL70W58l9l.
Youtube: "Applying False Lashes Underneath Your Own Top Eye Lashes Best Beauty Tip/Hack Ever," Jul. 2, 2016, 46 Pages, Retrieved from URL: https://www.youtube.com/watch2v-FzEtZgY-5Y8.
Youtube: "Applying Falsies Under Lash?! Does It Work?," Sep. 14, 2016, 57 Pages, Retrieved from URL: https://www.youtube.com/watch?v=V96EKKAe03c.
Youtube: "Applying Falsies Under Lash Does It Work!!," Sep. 27, 2016, 57 Pages, Retrieved from URL: https://www.youtube.com/watch?v=5kytWJOQbg.
Youtube: "Applying Falsies Underneath Lash," Sep. 24, 2016, 47 Pages, Retrieved from URL: https://www.youtube.com/watch?v=6VopJnVWv8s&t=13s.
Youtube: "Applying Falsies Underneath Reverse Best Lash Hack," Sep. 22, 2016, 20 Pages, Retrieved from URL: https://www.youtube.com/watch?v=GhG5hoMh000.
Hongiun Web Page: Oct. 31, 2018, 16 Pages, Retrieved from URL:https://detail.1686.com/offer/574685154963.html?spm=a2615.7691456.iewlist.75.22f96dc5Msy00t.
IEnvy: "Kiss-IEnvy Collection," 02 Pages, [Retrieved on Dec. 30, 2020] Retrieved from URL: ienvybykiss.com.
Imagessentials: "How to Wear False Eyelashes Without Looking Like You're Wearing Them," 2012, 5 Pages, Retrieved from URL: https://imagessentials.wordpress.com/2012/03/30/how-to-wear-false-eyelashes-without-looking-like-youre-wearing-any/.
Influenster: "Kiss I-Envy Eye Lash Adhesive (6g Individual, Clear) Reviews," 4 Pages, [Retrieved on Dec. 30, 2020] Retrieved from URL: https://www.influenster.com/reviews/kiss-i-envy-eye-lash-adhesive-6g-individual-clear.
Instagram: "Lashify Wand," 1 Page, [Retrieved on 2019] Retrieved from URL: https://www.instagram.com/p/BWgeQ8wg00SR/iqshid=zauiyw8a6v5.

(56) References Cited

OTHER PUBLICATIONS

International Search Report and Written Opinion for International Application No. PCT/US2017/044217, mailed Nov. 27, 2017, 15 Pages.
International Search Report and Written Opinion for International Application No. PCT/US2017/067513, mailed Mar. 12, 2018, 10 Pages.
International Search Report and Written Opinion for International Application No. PCT/US2019/057102, mailed Dec. 23, 2019, 12 Pages.
International Search Report and Written Opinion for International Application No. PCT/US2019/057104, mailed Dec. 19, 2019, 8 Pages.
International Search Report and Written Opinion for International Application No. PCT/US2020/013554, mailed May 7, 2020, 8 Pages.
International Search Report and Written Opinion for International Application No. PCT/US2020/013561, mailed May 7, 2020, 10 Pages.
International Search Report and Written Opinion for International Application No. PCT/US2020/054014, mailed Jan. 20, 2021, 11 Pages.
International Search Report and Written Opinion for International Application No. PCT/US2022/039083, mailed Oct. 31, 2022, 16 Pages.
International Search Report and Written Opinion for International Application No. PCT/US2022/045558, mailed Dec. 20, 2022, 15 Pages.
Japonesque False Eyelash Applicator, 1 Page.
Japonesque: "False Lash Applicator," Feb. 13, 2019, 6 Pages, Retrieved from URL: https://japonesque.com/products/implements/false-lash-applicator/.
Kiss Nail Products Inc: Third Supplemental Objections and Responses to Lashify, Inc.'s First Set of Interrogatories (Nos. 1-56) Investigation No. 337-TA-1226, "In the Matter of Certain Artificial Eyelash Extension Systems, Products, and Components Thereof," Mar. 10, 2021, 430 Pages.
KissUSA: "A True Lash Extension Look in Minutes Falscara the New Way to Lash," Feb. 5, 2021, 6 Pages, Retrieved from URL: https://www.kissusa.com/falscara-false-ayelash-extension-look.
KissUSA: "DIY Lash Extensions By: Kiss," May 20, 2021, 1 Page, [Retrieved on Apr. 7, 2023] Retrieved from URL: https://www.kissusa.com/kiss-falscara-eyelash-starter-kit-01.
KissUSA: "Falscara Starter Kit," Dec. 15, 2021, 1 Page, [Retrieved on Apr. 7, 2023] Retrieved from URL: https://www.kissusa.com/lashes/kiss-falscara-eyelash-starter-kit-01.
KissUSA: "Falsecara Eyelash By: Kiss," Sep. 20, 2020, 5 Pages, [Retrieved on Apr. 17, 2021] Retrieved from URL: https://web.archive.org/web/20201126033616/https://www.kissusa.com/lashes/kiss-falscara-eyelash-starter-kit-01.
KissUSA: "Kiss Falscara Eyelash-Bond Seal," 3 Pages, Retrieved from URL: https://www.kissusa.com/kiss-falscara-eyelash-bond-seal.
Lades: "Eyelashes Clip—2 Pieces False Eyelashes Applicator Tool Eyelash Extension Tweezers Remover Clip Nipper," Amazon, Aug. 2, 2017, 22 Pages, XP055720051, Retrieved from URL: https://www.amazon.co.uk/Eyelashes-Clip-Applicator-Extension-Tweezers/dp/B07PK6VBVW.
Lash Applicator By: Pro Lashbeauty (Dec. 14, 2023) https://www.amazon.com/dp/B0CB3ZZRTJ/ref=sspa_dk_detail_0psc=1&pd_rd_i=B0CB3ZZRTJ&pd_rd_w=v4LsU&content-id=amzn1.sym.68f30e61-3dba-4ebe-8f1b-a0b000b95ff8&pf_rd_p=(May 3, 2023).
Lashaddict: "Kiss I-Envy by Kiss Premium Quattro 02 Lashes," 4 Pages, [Retrieved on Dec. 30, 2020] Retrieved from URL: https://www.lashaddict.nl/kiss-i-envy-lashes-quattro-02.html.
Lashify: "Fuse Control Wand V2, Lashify," Reviewed on Oct. 23, 2018 on Lashify.com, 1 Page, [Retrieved on Dec. 31, 2018] Retrieved from URL: https://lashify.com/collections/lashify-tools/products/fuse-control-wand-v2variant=13400696586351#shopify-product-reviewsretrieved.
Lashify: "Lashify Gossamer Lash Cartridge," Jun. 15, 2018, 2 Pages, Retrieved from URL: https://lashify.com/collections/shop-1/products/gossamer-eye-lozenge-c-style/variant=783670738950.
Lashify: "Violet Gossamer," Sep. 30, 2020, 7 Pages, Site Visited Feb. 17, 2021, Retrieved from URL: https://lashify.com/products/gossamer-lash-cartridge-prismatic-colors-violetvariant=20045369835631.
Lindstrom I., et al., "Occupational Asthma and Rhinitis Caused by Cyanoacrylate-based Eyelash Extension Glues," Occupational Medicine, Apr. 3, 2013, vol. 63, No. 4, pp. 294-297.
Loveyelashes: "Kiss I-Envy Premium Quattro 01 Lashes," 2 Pages, [Retrieved on Dec. 30, 2020] Retrieved from URL: https://www.loveyelashes.com/bfont-colorgreenstrip-lashesfontb-299-envy-by-kiss-quattro-01-(1555,129,1,48)p.html#.
Mac Cosmetics: "34 Lash," Feb. 14, 2019, 1 Page, Retrieved from URL: http://www.bornprettystore.com/false-eyelashes-thick-natural-simulation-recyclable-curly-false-eyelash-makeup-cosmetic-tools-p-44675.html.
MAC: "Lash Applicator—For False Lashes, Precise, Convenient," MAC Cosmetics Official Site, 2014, 4 Pages, Retrieved From [https://www.maccosmetics.com/product/13811/32724/products/brushes-tools/tools/sponges-applicators/lash-applicator?].
Madame Madeline: "Ardell Dual Lash Applicator (62059)," 3 Pages, [Retrieved on Oct. 18, 2018] Retrieved from URL: https://www.madamemadeline.com/online_shoppe/proddetail.asp?prod=mm62059.
Madame Madeline: "Kiss I-Envy Premium Quattro 01 Lashes (KPE62)," 2 Pages, [Retrieved on Dec. 30, 2020] Retrieved from URL: https://www.madamemadeline.com/online_shoppe/proddetail.asp?prod=mmKPE62.
Made in China: "New Product Eyelashes Aid Eyelashes Applicator Innovative Eyelashes Curler," 2018, 2 Pages, [Retrieved on Feb. 13, 2019], Retrieved from URL: https://www.made-in-china.com/productdirectory.do?word=creative+eyelashe-curler&subaction=hunt&style=b&mode=and&code=0&comProvince=nolimit&order=0&isOpenCoiTection=1.
Matweb: "Overview Of Materials For Polybutylene Terephthalate (PBT), Unreinforced, Molded," [Retrieved on Mar. 29, 2023] 5 Pages, Retrieved from [URL: https://www.matweb.com/search/datasheet_print.aspx?matguid=781bd0e9d0854fd5a919866c39ea3065].
Modernbeauty: "Kiss I-Envy Individual Eye Lash Adhesive," 3 Pages, [Retrieved on Dec. 30, 2020] Retrieved from URL: https://www.modernbeauty.com/cosmetics/lashes/false-lashes/Product/26961-i-envy-individual-eyelash-adhesive-retail.html.
Notter E., "The Art of the Chocolatier from Classic Confections to Sensational Showpieces," John Wiley Sons, Jan. 18, 2011, 4 Pages.
Office Action for Australian Patent Application No. AU20190360273, mailed Nov. 13, 2023, 3 Pages.
Office Action for Australian Patent Application No. AU20220235619, mailed Nov. 14, 2023, 2 Pages.
Office Action for Canadian Patent Application No. 3123631, mailed Feb. 21, 2024, 06 Pages.
Office Action for Canadian Patent Application No. CA3123630 mailed on Jan. 19, 2024, 7 Pages.
Office Action for Chinese Patent Application No. 202080069380.8, mailed Mar. 2, 2024, 15 Pages.
Office Action for Chinese Patent Application No. 202110550925.3, mailed Oct. 31, 2023, 24 Pages.
Office Action for European Patent Application No. 17884561.6, mailed Mar. 5, 2024, 06 Pages.
Office Action for European Patent Application No. 20190873364, mailed Sep. 19, 2023, 7 Pages.
Office Action for European Patent Application No. 20190873364, mailed Mar. 22, 2024, 09 Pages.
Office Action for Indonesian Patent Application IDP00202205125 mailed Jan. 24, 2024, 3 pages.
Office action for Japanese Application No. 2019504850, dated Aug. 30, 2021, 8 Pages.

(56) References Cited

OTHER PUBLICATIONS

Office Action for Japanese Patent Application No. 2022121728, mailed Feb. 8, 2024, 02 Pages.
Japonesque: "False Lashes—Lashes Brows", Aug. 8, 2014, Retrieved from [https://web.archive.org/ web/20140808235016/ http:/japonesque.com/lashes-brows/false-lashes].
Jocelyn-Marcial: "How to Apply Strip Lashes Underneath VS on Top," Jocelyn Marcial Video, Mar. 17, 2017, 24 Pages, Retrieved from [https://www.youtube.com/watch?v=lu_ck8K4otw].
Kiss: "I Envy Knot Free Ultra Black Short (KPE04UB), Madame Madeline," Oct. 1, 2015, 3 pages, Retrieved from https://web.archive.org/web/20151001102530/https:/madamemadeline.com/online_shoppe/proddetail.asp? prod=mmKPE04UB.
Kiss: "Ever EZ Lashes Single Pack," The Wayback Machine, Jan. 1, 2015, 02 Pages, Retrieved from [https://web.archive.org/web/20150101185551/ http://www.kissusa.com/lashes/ever_ez_lashes/everez_lashes_single_pack#. VKWYPnbP1qY].
Kiss: "Ever-EZ Kiss Premium Lashes 03, Ever-EZ Lashes by Kiss—Madame Madeline," Jul. 8, 2016, 2 Pages, Retrieved from https://web.archive.org/web/20160708044512/https:/www.madamemadeline.com/online_shoppe/proddetail.asp?prod=mmKPL03.
Kiss: "I Envy by Kiss—How to Apply Individual Lashes," Nails R US Beauty Supply Ltd., Aug. 27, 2017, 17 Pages, Retrieved from [https://www.youtube.com/watch?v=qPLNB_WDJGw].
Kiss Looks So Natural False Eyelashes, Shy, 14 mm, 1 Pair, Sep. 26, 2024, 4 pages, Retrieved from https://www.walmart.com/ip/KISS-Looks-So-Natural-False-Eyelashes-Shy/34400580.
Kiss: "Strip Lashes Mul, "Haute Couture Multi Pack Lashes Wink, Sep. 26, 2014, 01 Page, Retrieved from [https://web.archive.org/web/20140926011512/ http://www.kissusa.com/lashes/haute_couture/haute_couture_lash_multipack#. VCS-QnbP2Uk].
Lash'EM: "Mink Fur Horse Mane Eyelashes," Apr. 28, 2014, 02 Pages, Retrieved from [https://web.archive.org/web/20140428032020/http://www.lashemlashes.com/services.html].
Long Tai LT-004 Lashes: "Exhibit A-39, Defendant's Final Invalidity Contentions," Jul. 12, 2023, United States District Court for the Western District of Texas—Waco Division, Case No. 6:22-cv-00776-ADA-DTG, *Lashify Inc*, v. *Qingdao Lashbeauty Cosmetic Co, Ltd. d/b/a Worldbeauty and Qingdao Hollyren Cosmetics Co, Ltd. d/b/a Hollyren*, 1 Page.
Madame Madaline: "Ardell Duralash Naturals Long Length," Sep. 10, 2025, 3 Pages, Retrieved from [https://web.archive.org/web/20150910130146/https:/www.madamemadeline.com/online_shoppe/proddetail.asp?prod=adl_I].
Madame Madaline: Ever EZ Kiss Premium Lashes, Kiss Premium Eyelashes, Madame Madaline, Apr. 10, 2016, 05 Pages, Retrieved from [https://web.archive.org/web/20160410103057/https:/www.madamemadeline.com/online_shoppe/products.asp?cat=EVER+EZ+LASHES+by+Kiss].
Madame Madeline: "Kiss I-Envy Au Naturale," Sep. 6, 2015, 05 Pages, Retrieved from [https://web.archive.org/web/20150906170057/https:/www.madamemadeline.com/online_shoppe/products.asp?cat=i-ENVY+Strip+Lashes +by+KISS].
Madame Madeline: "Ardell Duralash Knot-Free Double Individual Lashes Long," May 6, 2016, 2 Pages, Retrieved from [https://web.archive.org/web/20160506050354/https:/www.madamemadeline.com/online_shoppe/proddetail.asp? prod=mm61496].
Madame Madeline: "Ardell Duralash Knot-Free Double Individual Lashes Medium," May 6, 2016, 3 Pages, Retrieved from [https://web.archive.org/web/20160506015523/https:/www.madamemadeline.com/online_shoppe/proddetail.asp?prod=mm61485].
Madame Madeline: "Ardell Duralash Knot-Free Double Individual Lashes Short," May 6, 2016, 3 Pages, Retrieved from [https://web.archive.org/web/20160506053149/https:/www.madamemadeline.com/online_shoppe/proddetail.asp? prod=mm61484].
Madame Madeline: "Ardell Duralash Naturals Combo Pack," Sep. 10, 2015, 3 Pages, Retrieved from [https://web.archive.org/web/20150910090349/https:/www.madamemadeline.com/online_shoppe/proddetail.asp? prod=mm65063].
Madame Madeline: "Ardell Duralash Naturals Medium Length," Sep. 10, 2015, 3 Pages, Retrieved from [https://web.archive.org/web/20150910130347/https:/www.madamemadeline.com/online_shoppe/proddetail.asp? prod=adl_ml].
Madame Madeline: "Ardell Duralash Naturals Short Length," Sep. 10, 2015, 3 Pages, Retrieved from [https://web.archive.org/web/20150910130042/https:/www.madamemadeline.com/online_shoppe/proddetail.asp?prod=adl_s].
Madame Madeline: "Ardell Duralash Naturals Starter Kit," Sep. 10, 2015, 3 Pages, Retrieved from [https://web.archive.org/web/20150910093438/https:/www.madamemadeline.com/online_shoppe/proddetail.asp? prod=mm240462].
Madame Madeline: "Ardell False Eyelashes Accessories, Invisi Bands Lash Lites Eyelashes," False Eyelashes, Apr. 10, 2016, 05 Pages, Retrieved from [https://web.archive.org/web/20160410124330/https:/www.madamemadeline.com/online_shoppe/products.asp?cat=Ardell+InvisiBands+%26+LashLites+Eyelashes].
Madame Madeline: "Ardell InvisiBands Demi Luvies," Ardell InvisiBands LashLites Eyelashes, Sep. 10, 2015, 03 Pages, Retrieved from [https://web.archive.org/web/20150910131057/https:/www.madamemadeline.com/online_shoppe/proddetail.asp?prod=ail_dlv].
Madame Madeline: "Ardell InvisiBands Demi Wispies (New Packing)," Ardell InvisiBands LashLites Eyelashes, Sep. 10, 2015, 03 Pages, Retrieved from [https://web.archive.org/web/20150910130919/https:/www.madamemadeline.com/online_shoppe/proddetail.asp?prod=mm65012].
Madame Madeline: "Ardell Invisibands Wispies (New Packaging)," Sep. 21, 2015, 3 Pages, Retrieved from [https://web.archive.org/web/20150921002822/https:/www.madamemadeline.com/online_shoppe/proddetail.asp? prod=ail_wn].
Madame Madeline: Ardell Invisibands Wispies, Sep. 10, 2015, 3 Pages, Retrieved from [https://web.archive.org/web/20150910130131/https:/www.madamemadeline.com/online_shoppe/proddetail.asp?prod=ail_w].
Madame Madeline: "Ardell Lash Trios Individual Long Black," Jul. 16, 2017, 3 Pages, Retrieved from [https://web.archive.org/web/20170720061842/https:/www.madamemadeline.com/online_shoppe/products.asp?cat=Ardell +Individual+Trios+Lashes].
Madame Madeline: "Ever-EZ Kiss Premium Lashes 11," Madame Madeline, Jul. 8, 2016, 03 Pages, Retrieved from [https://web.archive.org/web/20160708105446/https:/www.madamemadeline.com/online_shoppe/proddetail.asp? prod=mmKPL01].
Madame Madeline: "I.Envy Individual Lashes Classic Flare Combo (KPE03)," Sep. 11, 2015, 5 Pages, Retrieved from [https://web.archive.org/web/20150911044752/https:/www.madamemadeline.com/online_shoppe/products.asp?cat=i-ENVY+Individual+Lashes+by+KISS].
Madame Madeline: "I.Envy Individual Lashes Knot Free Combo KPE06," Sep. 11, 2015, 3 Pages, Retrieved from [https://web.archive.org/web/20150911110942/https:/madamemadeline.com/online_shoppe/proddetail.asp? prod=mmKPE06].
Madame Madeline: "I-Envy Individual Lashes Trio Medium (KPEC02)," Sep. 27, 2015, 3 Pages, Retrieved from [https://web.archive.org/web/20150927140415/https:/www.madamemadeline.com/online_shoppe/proddetail.asp? prod=mmKPEC02].
Madame Madeline: "I.Envy Individual Lashes Trio Short (KPEC01)," Sep. 30, 2015, 3 Pages, Retrieved from [https://web.archive.org/web/20150930045649/https:/madamemadeline.com/online_shoppe/proddetail.asp? prod=mmKPEC01].
Madame Madeline: "I-Envy Individual Lashes Trio Ultra Black Short (KPEC01UB)," Sep. 29, 2015, 3 Pages, Retrieved from [https://web.archive.org/web/20150929123306/https:/madamemadeline.com/online_shoppe/proddetail.asp?prod=mmKPEC01UB].
Madame Madeline: "Japonesque Eyelashes Sectinal 4," Japonesque False Eyelashes, Sep. 10, 2015, 3 Pages, Retrieved from [https://web.archive.org/web/20150910073702/https:/www.madamemadeline.com/online_shoppe /proddetail.asp?prod=jpn410].
Madame Madeline: "Kiss i-Envy Au Naturale Multi-Pack 01 (KPEM08)," Strip Lashes by Kiss-Madame Madeline, Sep. 10, 2015, 02 Pages, Retrieved from [https://web.archive.org/web/20150910075201/https://www.madamemadeline.com/online_shoppe/proddetail.asp?prod=mmKPEM08].

(56) References Cited

OTHER PUBLICATIONS

Marilyn: "Ardell False Lashes Including the New Color Impact—Review, Photos and Looks," Mar. 6, 2013, 12 Pages, Retrieved from [https://weheartthis.com/ardell-false-lashes-including-the-new-color-impact-review-photos-and-looks/].
"MATA: Mahkota Tri Angjaya," Jul. 12, 2016, 1 Page, Retrieved from [https://web.archive.org/web/20160712154019/http:/www.mata-lashes.com].
MATA: "Process of Making Flare Eyelashes," PT. Mahkota Tri Angjaya, Nov. 12, 2015, 16 Pages, Retrieved [https://www.youtube.com/watch?v=UuJ3WNqiZWM].
Office Action for Chinese Patent Application No. 202110625150.1, mailed Aug. 30, 2024, 27 Pages.
Office Action for Japanese Patent Application No. 2023149877, mailed Jul. 1, 2024, 10 pages.
Premier Lashes: "Exhibit A-42, Defendant's Final Invalidity Contentions," Jul. 12, 2023, United States District Court for the Western District of Texas - Waco Division, Case No. 6:22-cv-00776-ADA-DTG,*Lashify Inc*, v. *Qingdao Lashbeauty Cosmetic Co, Ltd. d/b/a Worldbeauty and Qingdao Hollyren Cosmetics Co, Ltd. d/b/a Hollyren*, 4-5 Pages.
Pretty Casual: "Lashtite Glue DIY Eyelash Extensions—Apply Under My Lashes For A More Natural Look!," Mar. 26, 2016, 42 Pages, Retrieved from [https://www.youtube.com/watch?v=Td6Bi9aVmeQ].
Queenie-Chan: "Invisible Eyelash Extension Method—How to Apply False Eyelashes in a Special Way," BeautyQQ, Aug. 9, 2009, 20 Pages, Retrieved from [https://www.youtube.com/watch?v=lalQMuLByU].
Shu Uemura: "Slim Partial," Dec. 14, 2011, 1 Page, Retrieved from [https://web.archive.org/web/20111214144618/ http:/www.shuuemura-ysa.com/_us/_en/accessories/false-eyelashes/accent/slim-partial.htm].
Steale02: "How to Apply Individual Lashes," Steale02 Video, Apr. 5, 2010, 35 Pages, Retrieved from [https://www.youtube.com/watch?v=9X84CUIWqgo].
Toni Valentine: "How to Apply Individual Lashes," Mar. 16, 2013, 101 Pages, Retrieved from [https://www.youtube.com/watch?v=aLHE2SqzIO].
Walmart: Customer Reviews for KISS Looks So Natural, False Eyelashes, Shy, 14 mm, 1 Pair, 02 Pages, [Retrieved on Oct. 3, 2024], Retrieved from [https://www.walmart.com/reviews/product/34400580].
Wayback Machine: "Slim Partial—Accent Lashes by Shu Uemura Art of Beauty", Feb. 1, 2013, p. 1, Retrieved from https://web.archive.org/web/20130201021908/http:/www.shuuemura-usa.com/_us/_en/accessories/ false-eyelashes/accent/slim-partial.htm.
"WorldBeauty: Knot Free Flare Lashes," Exhibit A-44, Defendant's Final Invalidity Contentions, Jul. 12, 2023, 1 Page, United States District Court for the Western District of Texas—Waco Division, Case No. 6:22-cv-00776-ADA-DTG, *Lashify Inc*, v. *Qingdao Lashbeauty Cosmetic Co, Ltd. d/b/a Worldbeauty and Qingdao Hollyren Cosmetics Co, Ltd. d/b/a Hollyren*.
"WorldBeauty: Knot Free Flare Lashes", Aug. 17, 2012, 3Pages, Retrieved from [https://web.archive.org/web/20120817103827/ http:/www.worldbeautylashes.com:80/category/flare-eyelashes.html].
Adhesive: "Japonesque Sectional 4 Eyelashes," Sep. 26, 2024, 3 Pages, Retrieved from [https://www.amazon.com/JAPONESQUE-ZM-410-Sectional-4-Eyelashes/dp/B0038R1WOU/ref=cmcr_arp_d_pl_foot_top? ie=UTF8].
Alibaba: "False Eye Lashes 20D Individual Lashes Grafted Eyeslashes Extension," Oct. 2, 2024, 16 Pages, Retrieved from [https://www.alibaba.com/product-detail/false-eye-lashes-20D-individual-lashes_60689734967.html].
Amazon: "Ardell Knot-Free Individual Lash Double, Black, Medium," Retrieved on Oct. 3, 2024, 9 Pages, Retrieved from [https://www.amazon.com/Ardell-Double-Individuals-Flares-Black/dp/B00CAOFL66/ref=cm_cr_arp_d_product_top?ie=UTF8th=1].
Amazon: "Kiss I Envy Knot Free Medium 70 Lashes Ultra Black," [Retrieved on Oct. 3, 2024], 6 Pages, Retrieved from [https://www.amazon.com/Kiss-Medium-Lashes-Ultra-Black/dp/B017O6IMOM?th=1].
Amazon: "Kiss Looks So Natural Lashes Shy (2 Packs)," Beauty Personal Care, 05 Pages, [Retrieved on Oct. 4, 2024], Retrieved from [https://www.amazon.com/Kiss-Looks-Natural-Lashes-Pack/dp/B01AX2Z6NK].
Ardell: "Cluster Wispies 600," The Wayback Machine, Jun. 12, 2016, 03 Pages, Retrieved from [https://web.archive.org/web/20160612220611/ http:/ardelllashes.com/Lashes/product_246.html].
Ardell: "Cluster Wispies 603," The Wayback Machine, May 19, 2016, 03 Pages, Retrieved from [https://web.archive.org/web/20160519162211/ http:/www.ardelllashes.com:80/Lashes/product_247.html].
Ardell: "Short Black," Aug. 1, 2016, 3 Pages, Retrieved from [https://web.archive.org/web/20160801162839/http:/www.ardelllashes.com/Lashes/product_89.html].
Ardell: "Individual Lashes, "ProTip, Retrieved from [https://www.youtube.com/watch?v=6Peg8U65cK4].
Ardell: "Individual Lashes Started Kit," Jul. 6, 2016, 3 Pages, Retrieved from [https://web.archive.org/ web/20160706223201/http:/www.ardelllashes.com:80/Lashes/product_200.html].
Ardell: "Lash Lites," The Wayback Machine, Jul. 15, 2016, 02 Pages, Retrieved from [https://web.archive.org/web/20160715175102/ http://www.ardelllashes.com/Lashes/filter_41.html].
Ardell: "Lashes—Demi Wispies," Jun. 29, 2016, 1 page, Retrieved from https://web.archive.org/web/20160629220043/ http:/www.ardelllashes.com/Lashes/product_237.html.
"Ardell: Lashes Index," Jul. 15, 2016, Retrieved from [https://web.archive.org/web/20160715175029/ http:/www.ardelllashes.com/Lashes/index.html].
Ardell: "Lashes-Lash Trios," Jul. 15, 2016, 1 Page, Retrieved from [https://web.archive.org/web/20160715175032/http://www.ardelllashes.com/Lashes/product_238.html].
Ardell: "Lashes-Long Black" Jul. 8, 2016, 1 Page, Retrieved from [https://web.archive.org/web/20160715175032/http://www.ardelllashes.com/Lashes/product_238.html].
Ardell: "Long Black," Jul. 8, 2016, 3 Pages, Retrieved from [https://web.archive.org/web/20160708102833/http:/www.ardelllashes.com/Lashes/product_93.html].
Ardell: "Try on Lashes," The Wayback Machine, Jul. 15, 2016, 04 Pages, Retrieved from [https://web.archive.org/web/20160715175036/ http:/www.ardelllashes.com/Lashes/filter_108.html].
BEAUTE4U: "Stars Colors Eyelashes Soft Grafting Eyelash Extension Thick Style 20 Hairs Rabbit anti-Lashes XEB-009," Ideal Beaumax Marketing, Sep. 26, 2024, Retrieved from [https://beaute4u.com/index.php? id_product=56amp; controller=product].
Camie-Cameron: "How to Apply Individual Lashes Underneath the Eyelid," Camie Cameron Video, Jun. 27, 2016, 31 Pages, Retrieved from [https://www.youtube.com/watch?v=CabxTEY9qjc].
Edmarys: "Eyelash Hack | Reverse Lash Tutorial," Edmarys Video, Jan. 27, 2017, 22 Pages, Retrieved from [https://www.youtube.com/watch?v=NprJRiAQAi8].
"Fing'rs Lash Pocket," Oct. 1, 2024, 3 Pages, Retrieved from [https://www.amazon.de/-/en/Fing%60rs-Lashes-%20pocket/dp/B00ANLZTJS/ref=sr_1_1?qid=1686689361refinements=p_89%3AFing%60rs s=beautysr=1-1].
Glad Girl: "Glad Lash Signature 5D—vol. Fans—Mink Lashes Eyeslashes," Jun. 30, 2016, 3 pages, Retrieved from https://web.archive.org/web/20160630100924/ http:/www.eyelashextensions.com/eyelashes/mink-lashes/volume-fans/glad-lash-signature-5d.html.
Glad Girl: "Glad Lash Signature Double Configuration D Y Eyelashes," Sep. 26, 2024, 3Pages, Retrieved from [https://www.gladgirl.com/products/glad-lash-signature-double-configuration-2d-y-eyelashes?srsltid=AfmBOoqEbsioiLD0iJpG4gdT1JyfJq7Z32u6_9fhODFwjWJV9vRN_Uoamp;variant=31337154150452].
Glad Girl: "Knot-Free Flare Lashes—Eyelashes," Feb. 24, 2016, 3 Pages, Retrieved from https://web.archive.org/web/20160224231654/ http:/www.eyelashextensions.com/knot-free-medium-10-hair-7261.html.

(56) References Cited

OTHER PUBLICATIONS

Gladgirl: "W Lashes," Mar. 23, 2016, 2 Pages, Retrieved from [https://web.archive.org/web/20160323083727/http:/www.eyelashextensions.com/eyelashes/mink-lashes/w-lashes.html].
GladGirl: "Glad Lash Belle Strip Lash Application—Under Lash Line Technique," Eyelash Extension Supplies, Jan. 31, 2014, 10 Pages, Retrieved from [https://www.youtube.com/watch?v=6xnLNxbqVKM].
GladGirl: "Glad Lash Demi Whispy Strip Lash Application—Under Lash Line Technique," Eyelash Extension Supplies, Jun. 3, 2013, 11 Pages, Retrieved from [https://www.youtube.com/watch?v=Fpsr-XgWQwk].
GladGirl: "Knot-Free," Mar. 22, 2016, 2 Pages, Retrieved from [https://web.archive.org/web/20160322053913/http:/www.eyelashextensions.com/eyelashes/flare-lashes/knot-free.html].
"GladGirl: Lash Index," Mar. 10, 2016, 3 Pages, Retrieved from [https://web.archive.org/web/20160310145533/http:/www.eyelashextensions.com/eyelashes.html].
GladLash: "Signature 4D," Jun. 27, 2016, 5 Pages, Retrieved from [https://web.archive.org/web/20160627013832/http:/www.eyelashextensions.com/eyelashes/mink-lashes/volume-fans/gladlash-signature-4d.html].
GladLash: "Knot-Free W Lash Off the Tray," Jun. 30, 2016, 5 Pages, Retrieved from [https://web.archive.org/web/20160630041938/ http:/www.eyelashextensions.com/eyelashes/mink-lashes/w-lashes/knot-free-w-lash-off-the-tray.html].
Guglielmo A.D., "The New Way To Apply False Lashes," Stylecaster, Feb. 6, 2015, 2 Pages, Retrieved from [https://web.archive.org/web/20160201132329/ http://stylecaster.com/beauty/false-eyelashes-application-tip/].
HollyRen: "Beautiful Knot Free Flare Eyelashes for Daily Life #H03," Jun. 11, 2016, 4 Pages, Retrieved from [https://web.archive.org/web/20160611120459/ http://www.hollyren.com/Beautiful-Knot-Free-Flare-Eyelashes-For-Daily-Life-H03_215.html].
"HollyRen: False Eyelashes," Jun. 11, 2016, 2 Pages, Retrieved from [https://web.archive.org/web/20160611120415/ http:/www.hollyren.com/all-categories.html].
HollyRen: "Make Beauty Easier, Individual Flare Lashes," Jun. 11, 2016, 3 Pages, Retrieved from https://web.archive.org/web/20160611032519/ http:/www.hollyren.com/Individual-Flare-Lashes_cpid9.
HollyRen: "Make Beauty Easier, Regular Lashes, Beautiful Fashion False Eyelash For Daily Life #A02 products," Jun. 10, 2016, 2 Pages, Retrieved from https://web.archive.org/web/20160610231445/ http:/www.hollyren.com/Regular-Lashes_cpid12.
HollyRen: "Make Beauty Easier, Super Soft Faux Mink False Eyelashes products," Apr. 6, 2016, 2 Pages, Retrieved from https://web.archive.org/web/20160406204549/ http:/www.hollyren.com/Faux-Mink-False-Eyelashes_cpid38.
HollyRen: "Make Beauty Easier, Tip Mellow Lashes, Natural Look Tipped Criss Cross False Eyelash #BY05," Jun. 11, 2016, 2 Pages, Retrieved from https://web.archive.org/web/20160611032812/ http:/www.hollyren.com/Tip-Mellow-Lashes_cpid3.
HollyRen: "Natural Look Tipped Criss Cross False Eyelash #BY05," May 29, 2016, 2 Pages, Retrieved from [https://web.archive.org/web/20160529101843/ http:/www.hollyren.com/Natural-Look-Tipped-Criss-Cross-False-Eyelash-BY05_46.html].
HollyRen: "Quotation of EyeLash Extensions 2013," Jul. 12, 2023, 1 Page, Exhibit F-3 Summary Chart, Defendant's Final Invalidity Contentions, United States District Court for the Western District of Texas—Waco Division, Case No. 6:22-cv-00776-ADA-DTG, *Lashify Inc*, v. *Qingdao Lashbeauty Cosmetic Co, Ltd. d/b/a Worldbeauty and Qingdao Hollyren Cosmetics Co, Ltd. d/b/a Hollyren*.
HollyRen: Super Soft Faux Mink False Eyelashes SS03, May 28, 2016, 2 Pages, Retrieved from [https://web.archive.org/web/20160528090621/ http:/www.hollyren.com/Super-Soft-Faux-Mink-False-Eyelashes-SS03_4812.html].
HollyRen: Super Soft Faux Mink False Eyelashes SS06, May 28, 2016, 2 Pages, Retrieved from [https://web.archive.org/web/20160528084206/ http:/www.hollyren.com/Super-Soft-Faux-Mink-False-Eyelashes-SS06_4815.html].
HollyRen: "Super Soft Faux Mink False Eyelashes SS08," Qingdao Hollyren Cosmetics Co., Ltd, May 28, 2016, 02 Pages, Retrieved from [https://web.archive.org/web/20160528094955/ http:/www.hollyren.com/Super-Soft-Faux-Mink-False-Eyelashes-SS08_4817.html].
HollyRen: "Super Soft Faux Mink False Eyelashes SS11" Qingdao Hollyren Cosmetics Co., Ltd, May 28, 2016, 02 Pages, Retrieved from [https://web.archive.org/web/20160528144715/ http:/www.hollyren.com/Super-Soft-Faux-Mink-False-Eyelashes-SS11_4820.html].
Husssh SG: "How to Apply Husssh DIY Lashes," HussshSG video, May 28, 2010, 15 Pages, Retrieved from [https://www.youtube.com/watch?v=AIBSySwqsOY].
I.Envy By Kiss: "Quattro Collection Ad," Hype Hair Magazine, Nov. 2015, vol. 22(8), 1 Page.
I.Envy: "Knot-Free," Jan. 31, 2015, 2 Pages, Retrieved from [https://web.archive.org/web/20150131220543/ http:/ienvybykiss.com/2013/portfolio-type/knot-free/].
I.Envy: "Trio Lash-KPECO1UB/02US," Jan. 31, 2015, 2 Pages, Retrieved from [https://web.archive.org/web/20150131220846/ http:/ienvybykiss.com/2013/portfolio/trio-lash-kpec01ub02ub/].
Japonesque: "Sectional 4 Lashes," Aug. 10, 2014, 1 Page, Retrieved from [https://web.archive.org/web/20140810125817/ http:/japonesque.com/lashes-brows/false-lashes/eyelash-sectional-4].
Japonesque: "Sectional 4 Lashes," Oct. 2, 2024 4 Pages, Retrieved from [https://www.amazon.com/JAPONESQUE-ZM-410-Sectional-4-Eyelashes/dp/B0038R1WOU/ref=cm_cr_arp_d_pl_foot_top?ie=UTF8].
Office Action for Singapore Application No. 20211106861U, mailed Aug. 30, 2024, 07 Pages.
Office Action for Singapore Patent Application No. 11202107264P, mailed Sep. 10, 2024, 6 Pages.
BLINC: Blinc Heated Lash Curler, Heated Eyelash Curler Comb, Electric Eyelash Curler For Long Lasting Curls, Battery Included, , Reviewed on Dec. 2015, 1 Page, Retrieved from [https://www.amazon.com/Eyelash-Electric-Lasting-Battery-Included/dp/B000LJCNFA/ref=sr_1_26?dib=eyJ2IjoiMSJ9.g2WgUKFLa50bQ2jj1].

* cited by examiner

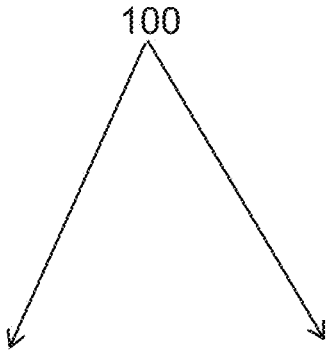
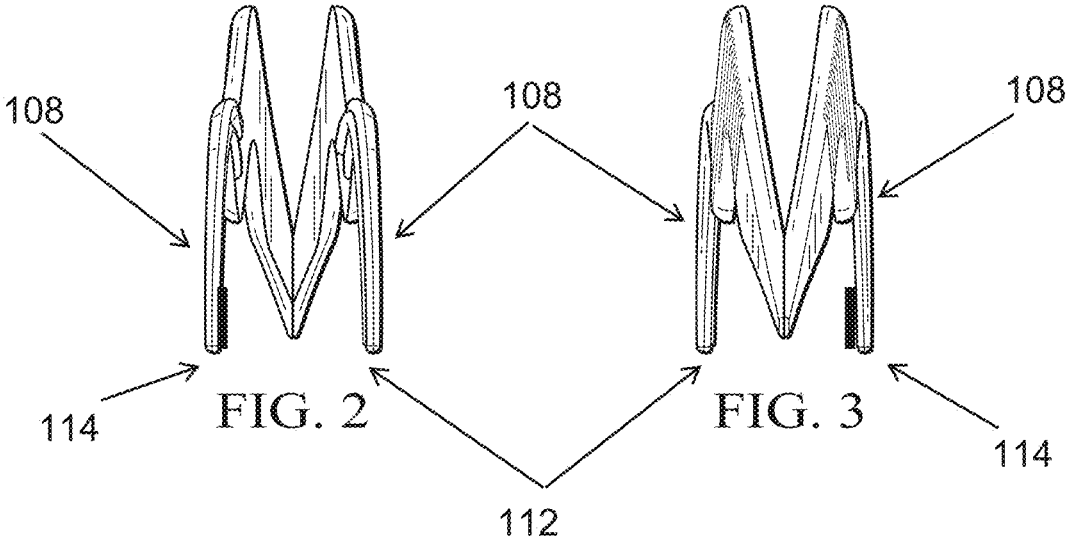
FIG. 2
FIG. 3

FIG. 6
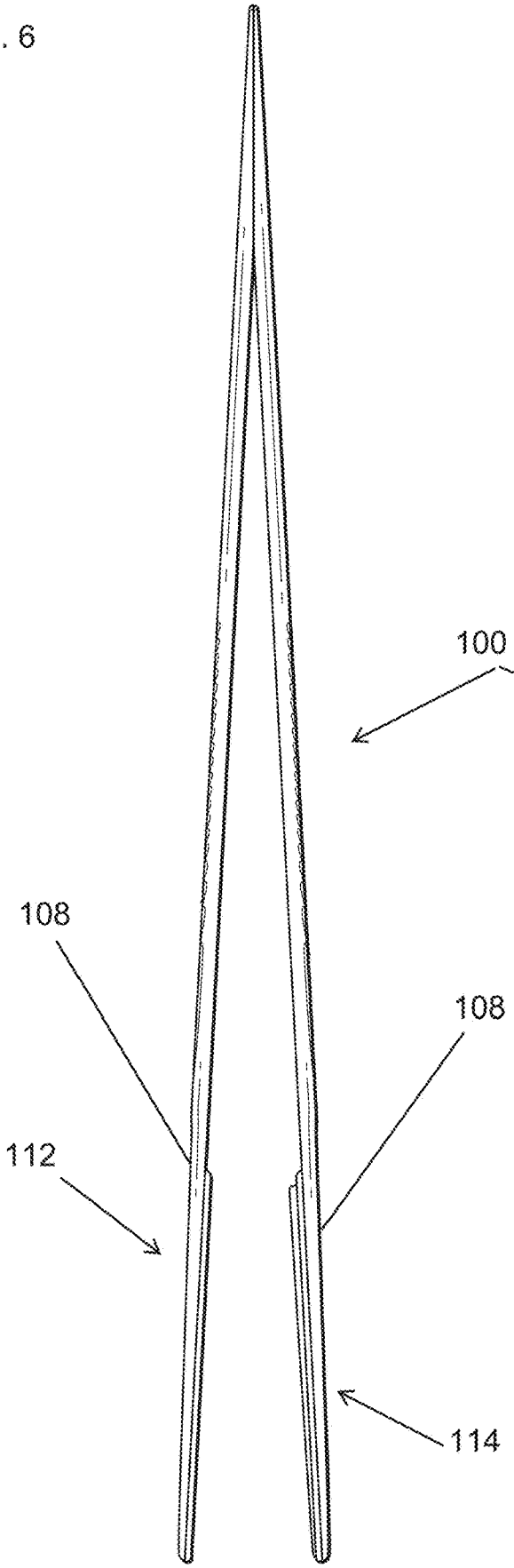
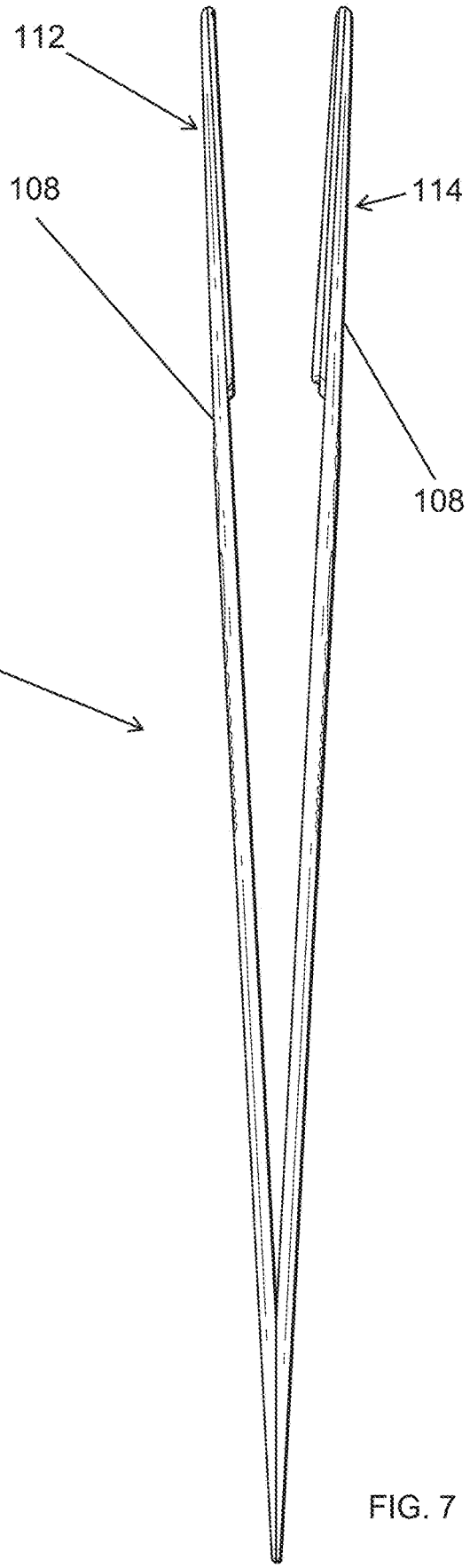
FIG. 7

FIG. 12
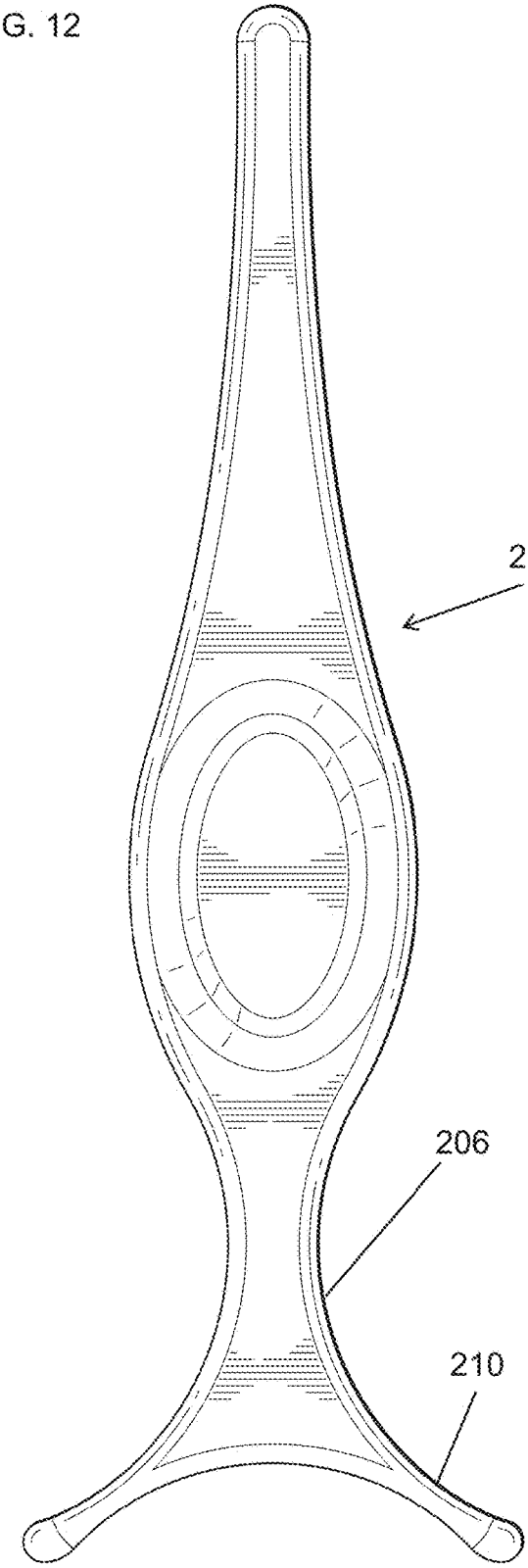
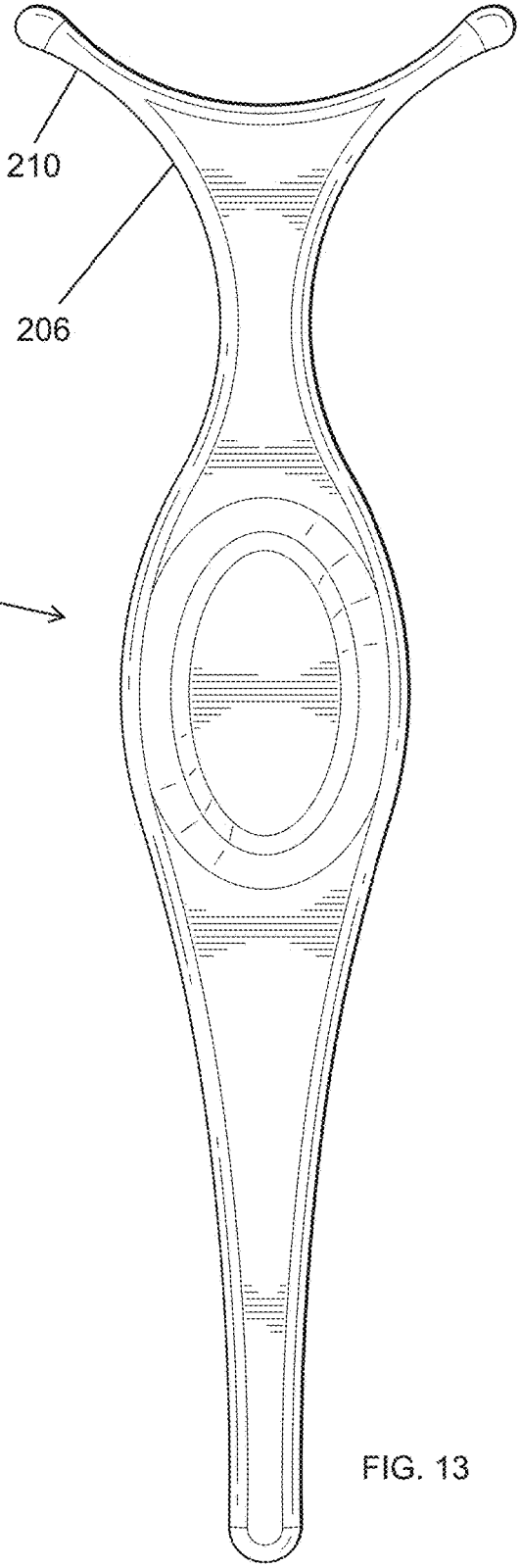
FIG. 13

FIG. 14
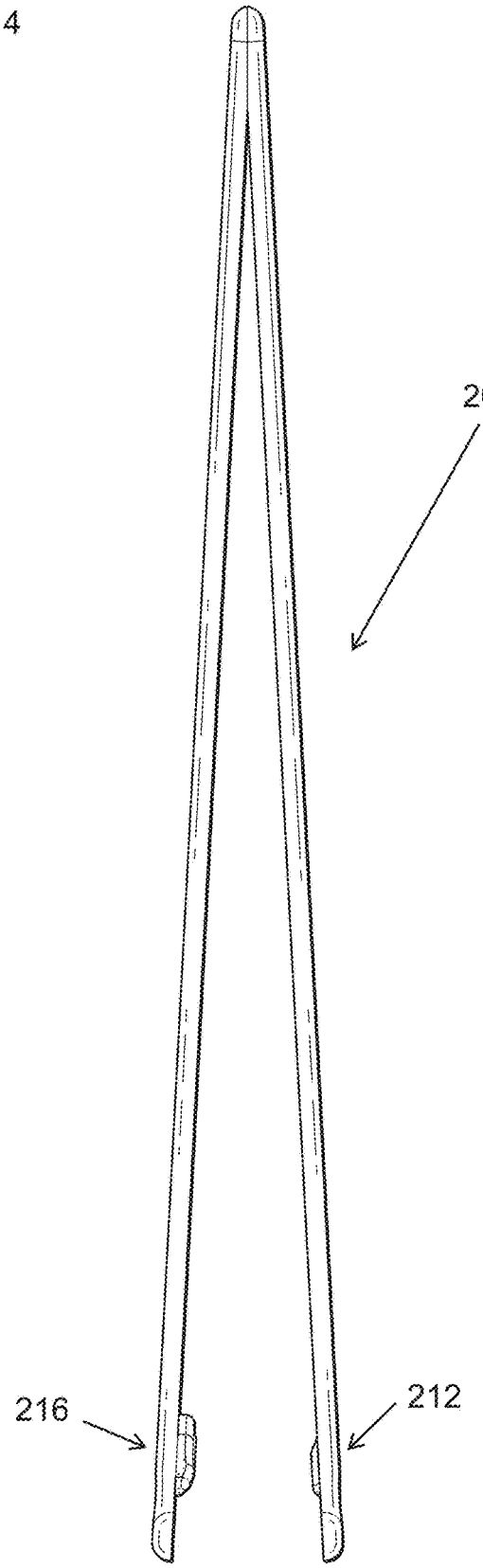
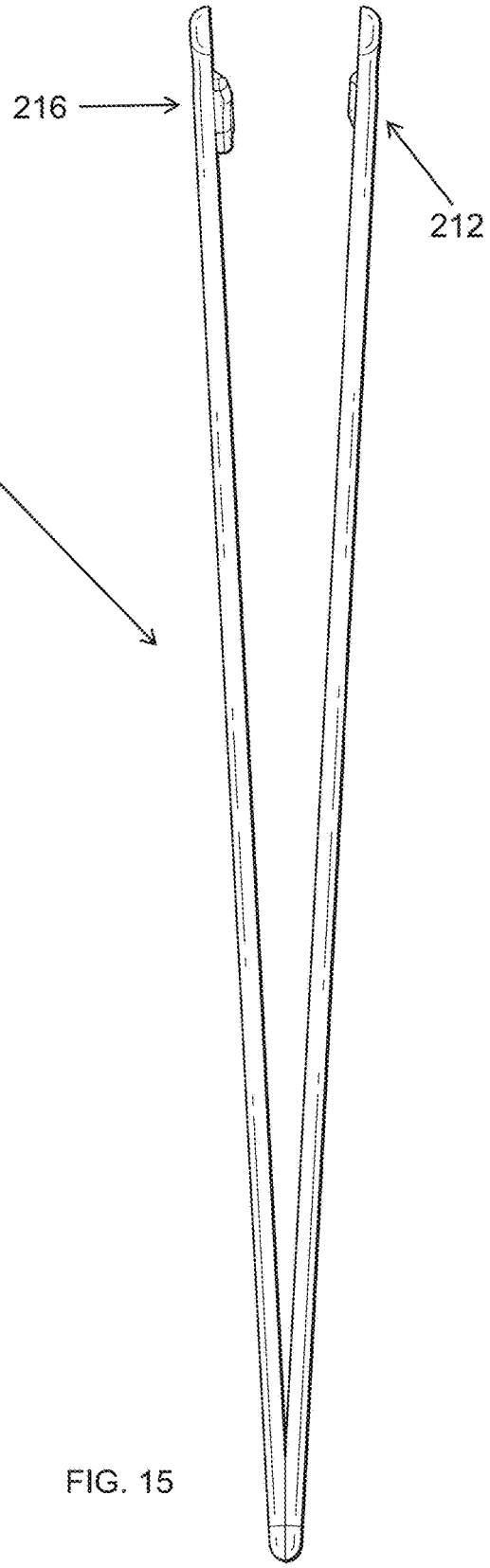
FIG. 15

APPLICATORS FOR APPLYING EYELASH EXTENSIONS AND METHODS FOR USE AND MANUFACTURE THEREOF

CROSS-REFERENCE TO RELATED PATENT APPLICATIONS

This patent application is a Continuation of U.S. patent application Ser. No. 16/810,787, filed Mar. 5, 2020, which is a Continuation of International Patent Application PCT/US2019/057102, filed Oct. 19, 2019, which claims a benefit of U.S. Provisional Patent Application 62/748,335, filed Oct. 19, 2018, the entire contents of all are hereby incorporated herein by reference in their entirety for all purposes.

TECHNICAL FIELD

This disclosure relates to applicators for applying eyelash extensions to natural eyelashes.

BACKGROUND

An applicator can be used to apply an eyelash extension to a natural eyelash of a user via an adhesive. However, the adhesive may not properly adhere to the eyelash extension or the natural eyelash. For example, the adhesive may not spread properly or clump.

SUMMARY

Broadly, this disclosure enables applicators for applying eyelash extensions and methods for use and manufacture thereof. In particular, these applicators these applicators host male/female tips that can improve application of adhesives to eyelash extensions or natural eyelashes. Regardless of the applicators shaping (e.g., lash curler style) or not shaping the eyelash extensions or the natural eyelashes, the male/female tips aid, enable, or cause spreading of the adhesives (e.g., along male projections, within female depressions) or makes the adhesives less user visible (e.g., minimize clumping of adhesives).

In an embodiment, an applicator comprising: a first arm having a first grasping tip that is arcuate, wherein the first grasping tip has a first inner side hosting a male portion; and a second arm having a second grasping tip that is arcuate, wherein the second grasping tip has a second inner side hosting a female portion, wherein the first inner side faces the second inner side, wherein the male portion and the female portion avoid mating when the first arm and the second arm are at a default position, wherein the male portion and the female portion mate when the first arm and the second arm are at a grasping position.

In an embodiment, a method comprising: causing a lash extension to be grasped between a male portion of a first inner side of a first arcuate tip of a first arm of an applicator and a female portion of a second inner side of a second arcuate tip of a second arm of the applicator while the male portion and the female portion mate and the first inner side faces the second inner side; and causing the lash extension to be released onto a natural lash of the user via not mating the male portion and the female portion while the first inner side faces the second inner side.

Another embodiment of an applicator may include a first arm including a first grasping tip having a first inner side including at least one protrusion that defines a male portion. A second arm may include a second grasping tip having a second inner side including at least one depression that defines a female portion. The first inner side may face the second inner side such that the male portion and the female portion are aligned with one another such that when the first arm and the second arm are in an open position, the male and female portions are separated from one another, and when the first arm and second arm are in a closed position, the male portion and the female portion mate with one another.

Another embodiment of a method may include causing an adhesive holding a lash extension formed of multiple fibers and natural lashes together to be simultaneously grasped between at least one protrusion defining a male portion of a first inner side of a first tip of a first arm disposed on an applicator and at least one depression that defines a female portion disposed on a second inner side of a second tip of a second arm of the applicator, thereby causing the adhesive to be spread along a region between the male and female portions.

One embodiment of a method for redistributing an adhesive applied to a lash extension formed of multiple fibers and natural lashes may include causing the adhesive disposed on the natural lashes and lash extension to extend along a surface of an elongated depression disposed on a first tip of a first arm of an applicator and a surface of an elongated protrusion disposed on a second tip of a second arm when the elongated protrusion is vertically extended into the elongated depression with the adhesive, natural lashes, and lash extension being positioned between the elongated depression and elongated protrusion.

One embodiment of a method of manufacturing an applicator may include forming a first arm including a first grasping tip having a first inner side including at least one protrusion that defines a male portion, and forming a second arm including a second grasping tip having a second inner side including at least one depression that defines a female portion. The first and second arms may be connected at a first end opposite a second end at which the first and second grasping tips are located, and with the first inner side facing the second inner side. The male portion and the female portion may be aligned with one another so that when the first arm and the second arm are in an open position, the male and female portions are separated from one another, and when the first arm and second arm are in a closed position, the male portion and the female portion mate with one another.

DESCRIPTION OF DRAWINGS

FIGS. 1-8 show a plurality of views of an embodiment of an applicator according to this disclosure.

FIGS. 9-16 show a plurality of views of an embodiment of an applicator according to this disclosure.

DETAILED DESCRIPTION

Figure 1:
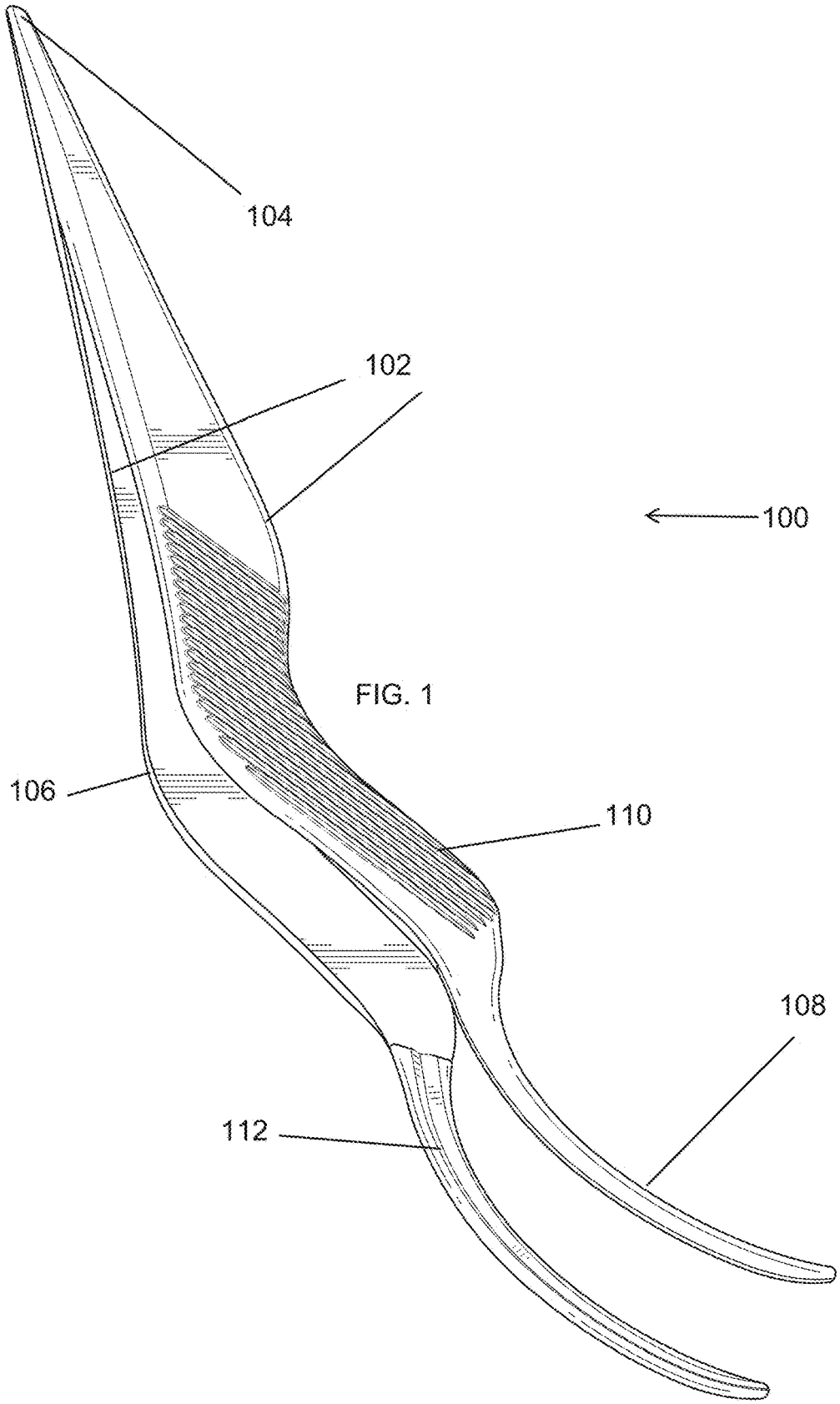
Figure 4:
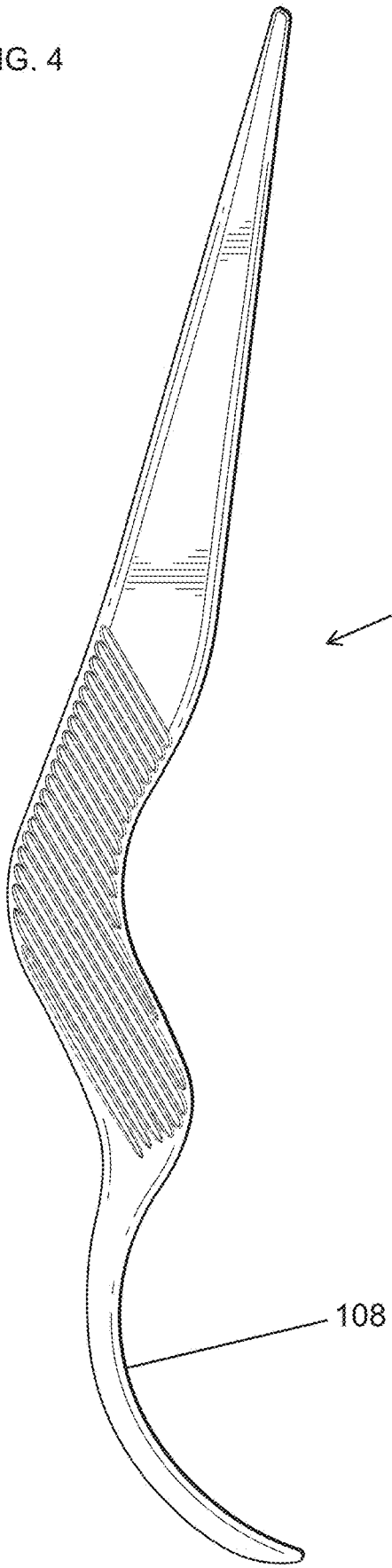
Figure 5:
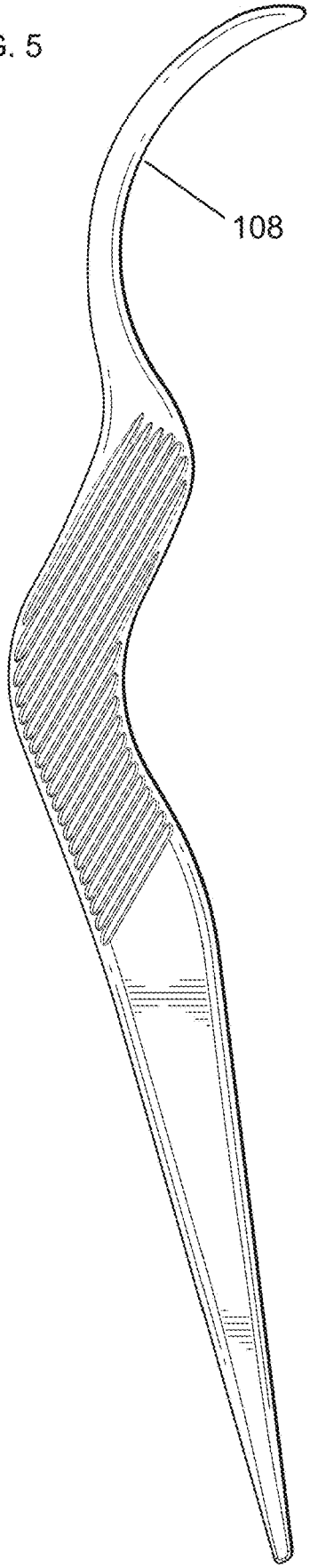
Figure 5:
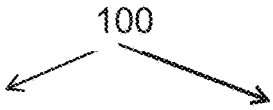
Figure 8:
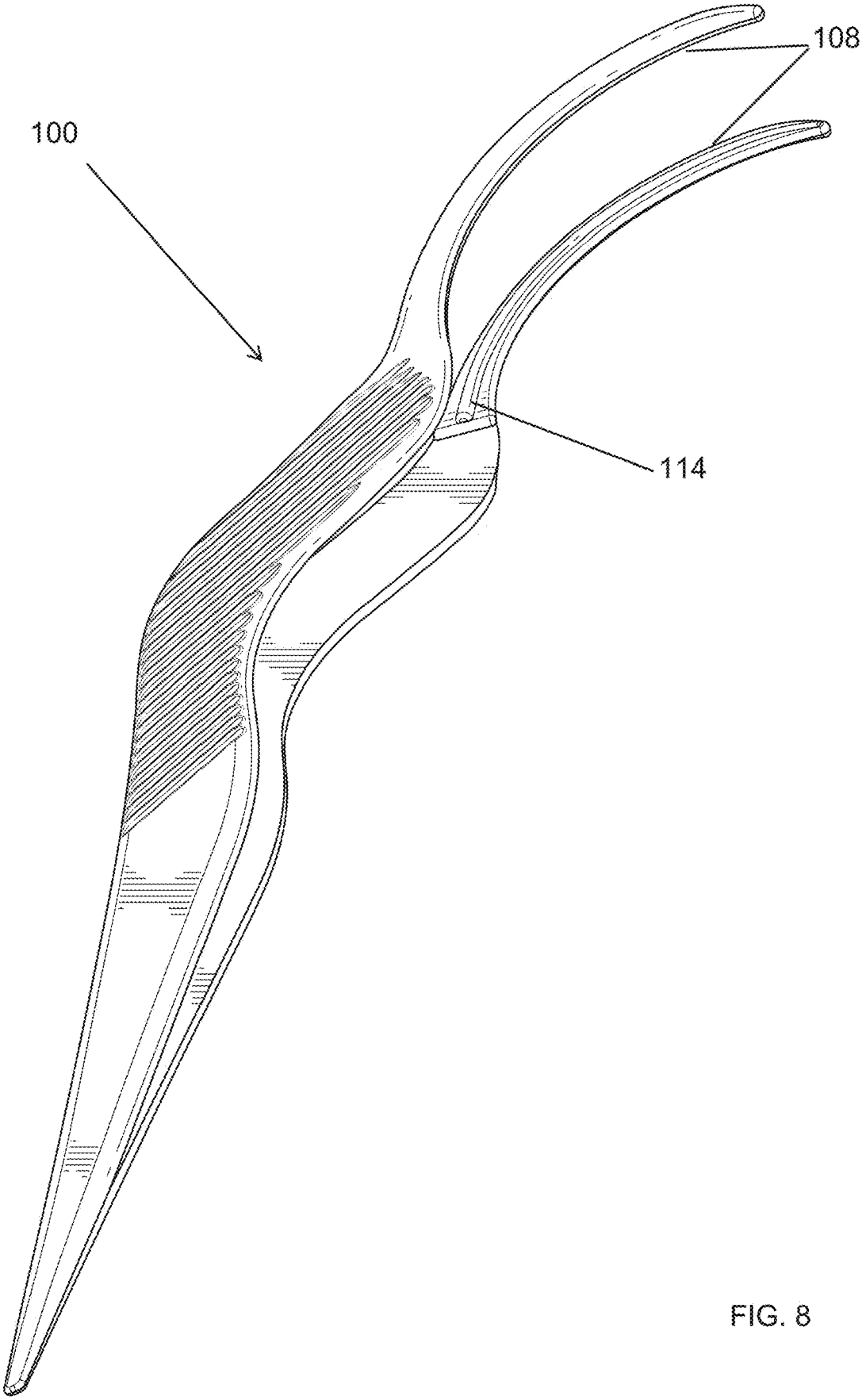
Figure 9:
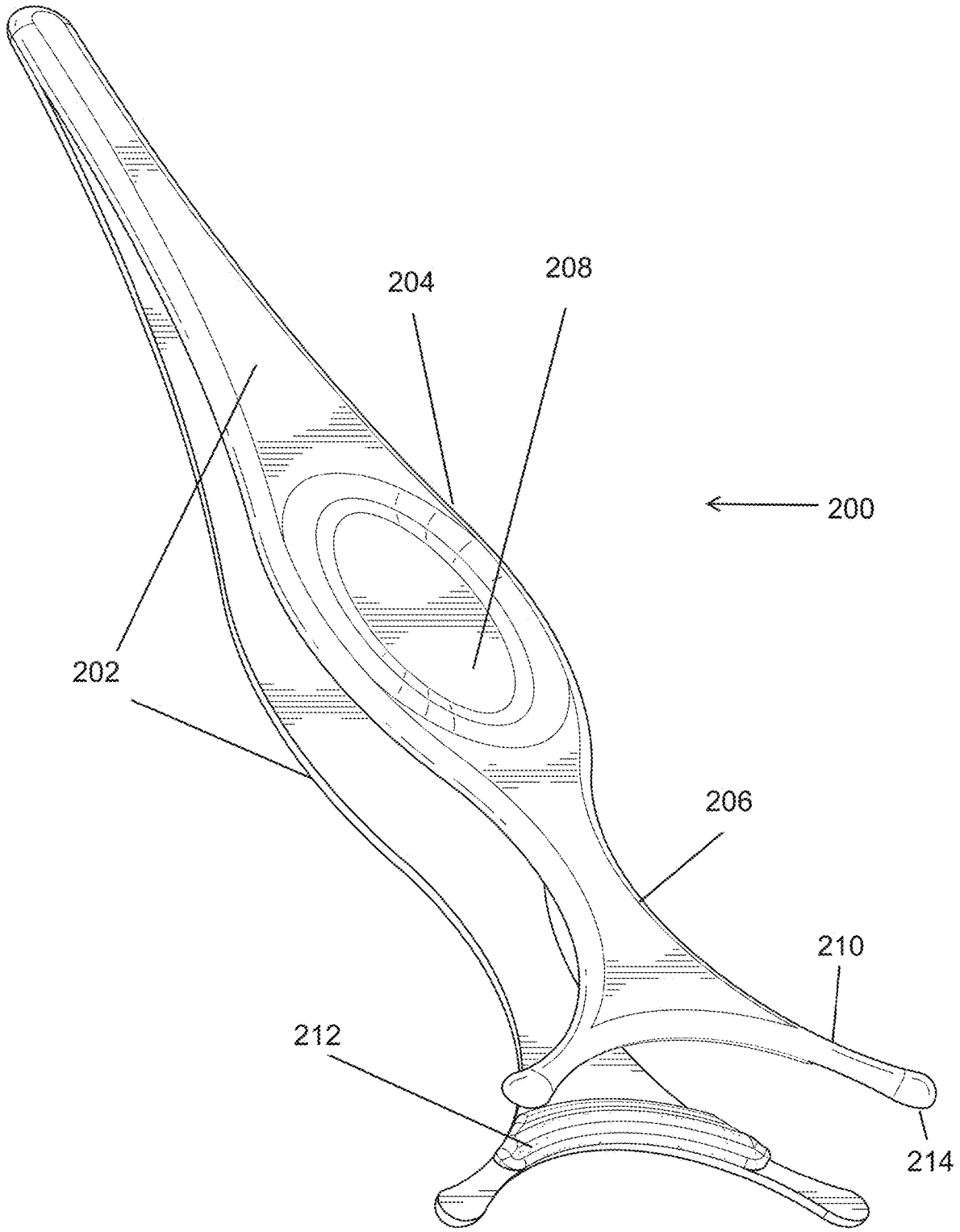
Figures 10, 11:
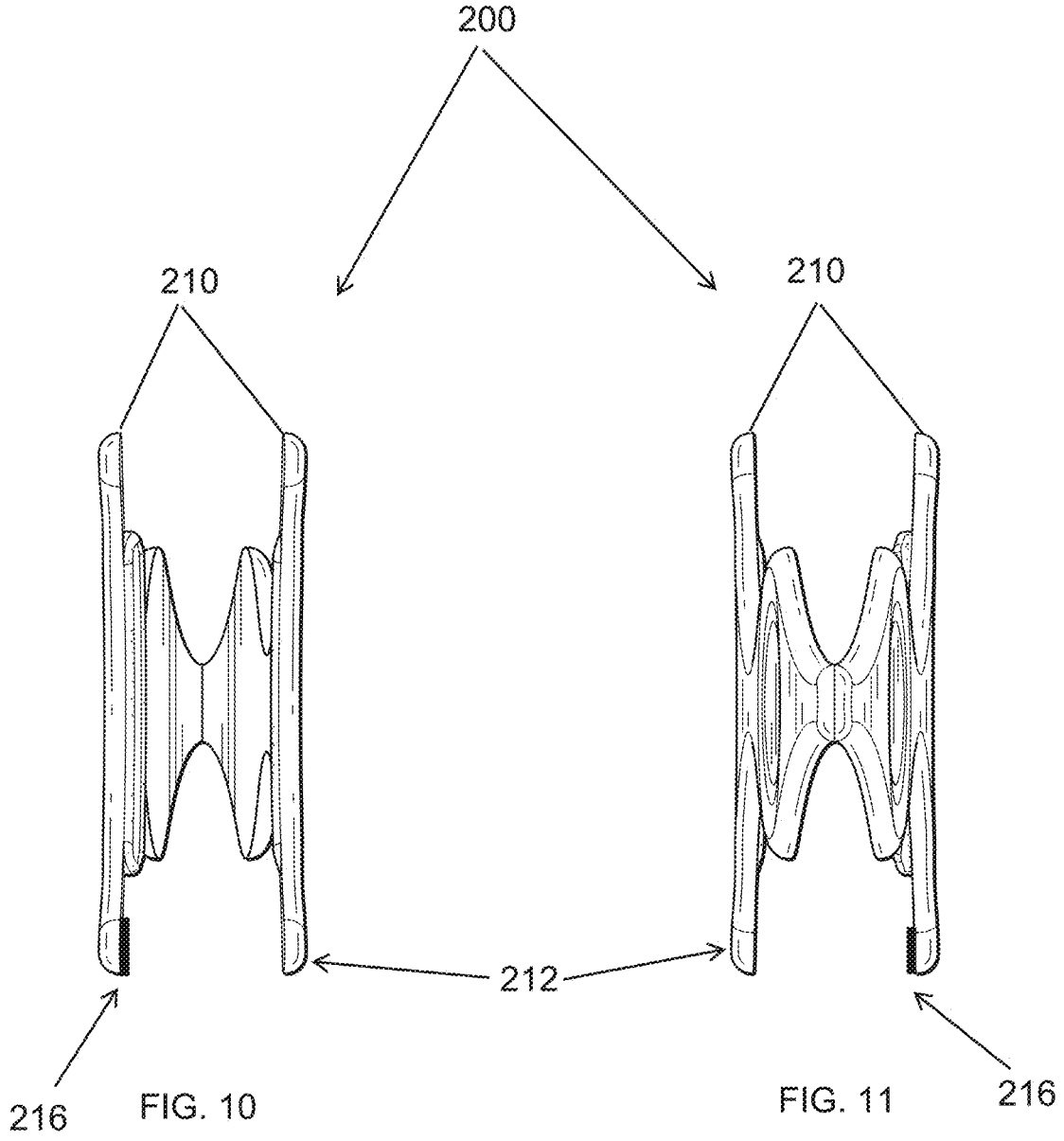
Figure 16:
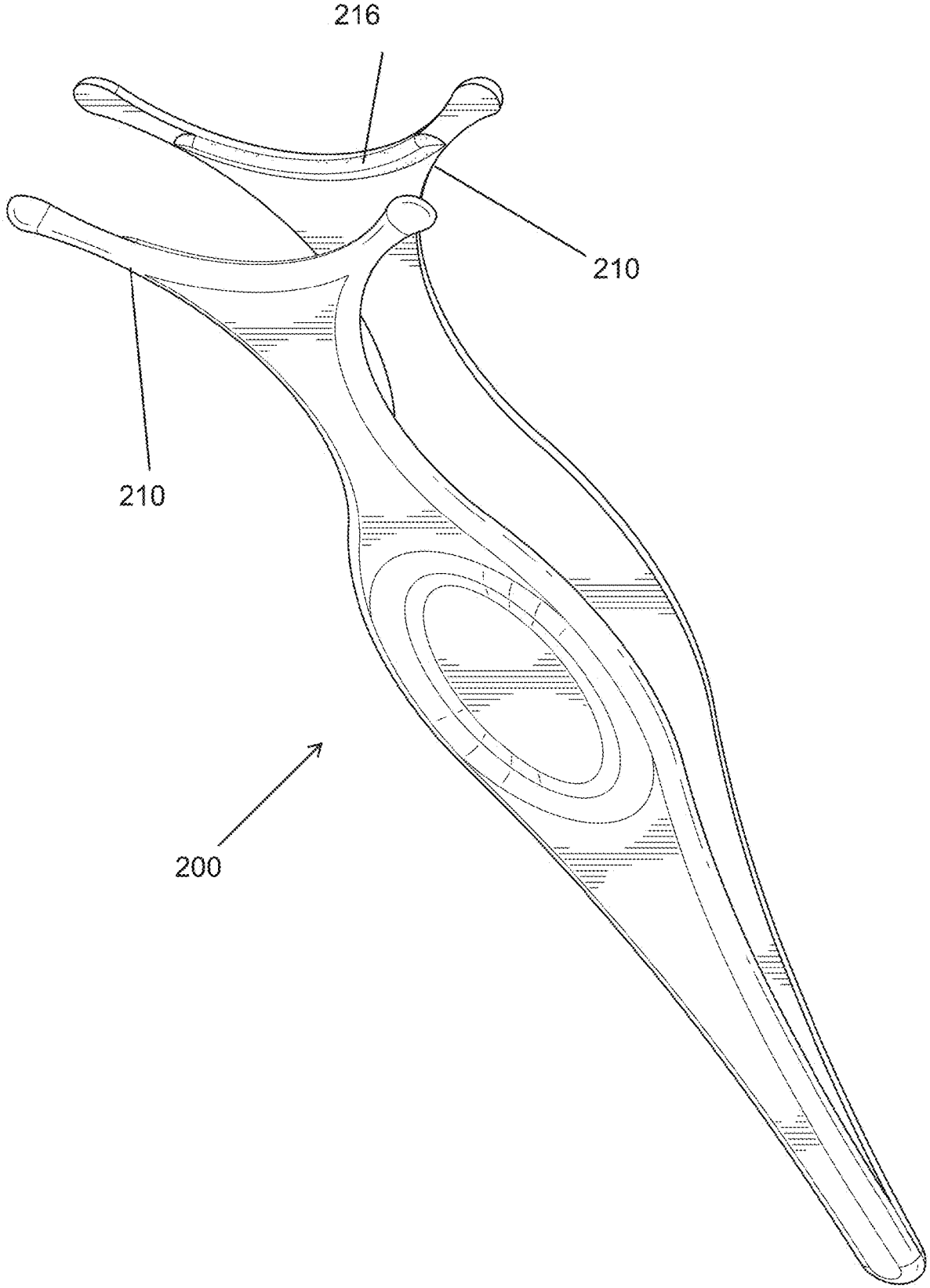

Generally, this disclosure enables applicators for applying eyelash extensions and methods for use and manufacture thereof. In particular, these applicators host male/female tips that can improve application of adhesives to eyelash extensions or natural eyelashes. Regardless of the specific shape of the applicators, the male/female tips aid, enable, or cause spreading of the adhesives (e.g., along male projections, within female depressions) and/or makes the adhesives less user visible (e.g., minimize clumping of adhesives).

FIGS. 1-8 show a plurality of views of an embodiment of an applicator according to this disclosure. In particular, an applicator 100 (e.g., tweezer, tongs) includes a pair of arms 102 having a pair of medial portions 106 and a pair of grasping tips 108. The pair of arms 102 are joined at a common point 104 such that the pair of medial portions 106 are positioned between the common point 104 and the pair of grasping tips 108 and such that the pair of arms 102 define a default position shaped in a V-shape. As such, the pair of arms 102 are in the default position when defining the V-shape via the common point 104. Therefore, the applicator 100 includes the first arm 102 having the first grasping tip 108 that is arcuate and the second arm 102 having the second grasping tip 108 that is arcuate.

Each arm of the pair of arms 102 has an inner side and an outer side such that the inner sides face each other in the default position and such that the pair of arms 102 are symmetrical to each other at the medial portions 106 or at the grasping tips 108. It should be understood that non-symmetrical embodiments are possible.

Each of the medial portions 106 of the pair of medial portions 106 is humped such that a concave shape is defined thereby (e.g., for resting against a user's cheekbone or user's nose bridge). Likewise, each grasping tip 108 of the pair of grasping tips 108 is arcuate such that an arcuate shape is defined thereby. As such, the concave shapes and the arcuate shapes are respectively positionally consecutive and respectively face a same direction respectively lateral to the pair of arms 102. Correspondingly, each medial portion of the pair of medial portions 106 and each grasping tip of the pair of grasping tips 108 consecutively and longitudinally extend such that a valley is defined there between. These valleys respectively longitudinally oppose each other in the default position.

Each medial portion of the pair of medial portions 106 has the outer side that has a textured portion 110, in this case parallel grooves and ridges, but can also be non-textured. The outer sides of the medial portions 106 face opposite directions.

The grasping tips 108 include a first grasping tip 108 and a second grasping tip 108. The first grasping tip 108 has a first inner side hosting, including, or defining a male portion 114 (e.g., projection). Although the male portion 114 is D-shaped, the male portion 114 can be shaped differently (e.g., U-shape, C-shape, V-shape, P-shape, B-shape, or other shape). The male portion 114 can be continuous (e.g., single projection, protrusion, or otherwise) or discontinuous (e.g., set of projections that are positionally proximate one another). The second grasping tip 108 has a second inner side hosting, including, or defining a female portion 112 (e.g., depression). Although the female portion 112 is shaped to receive a D-shape, the female portion 112 can be shaped differently for receiving other shapes (e.g., U-shape, C-shape, V-shape, P-shape, B-shape, or other shape). The female portion 112 can be continuous (e.g., single depression) or discontinuous (e.g., set of depressions that are positionally proximate). In general, the male portion 114 and female portion 112 have reciprocal profiles so that when the grasping tips 108 are closed, the portions 114 and 112 mesh with one another, thereby spreading a fluid adhesive disposed on eyelashes so as to be more evenly distributed to cause the eyelash extensions to appear more natural.

The male portion 114 and the female portion 112 are spaced from one another when the first arm 102 and the second arm 102 are at the default or open position in the V-shape. However, the male portion 114 and the female portion 112 mate (i.e., fit together with an elongated protrusion of the male portion 114 extending into an extended protrusion of the female portion 112) when the first arm 102 and the second arm 102 are in a closed or grasping position. The grasping position is formed when the first grasping tip 108 and the second grasping tip 108 are moved closer to each other from the default position by a user squeezing the arms 102 together. For example, in the grasping position, the first arm 102 and the second arm 102 can form an I-shape. Likewise, the first grasping tip 108 and the second grasping tip 108 can be moved away from each other toward the default position by a user reducing pressure to the first grasping tip 108 or to the second grasping tip 108 or to at least one of the medial portions 106, which can be at that respective textured portion 110. As such, the arms 102 can resiliently move or be biased to move between the grasping position and the default position (e.g., from grasping position to the default position).

The applicator 100 can be used to perform a process of applying false eyelashes to natural eyelashes. A user may initially apply an adhesive to a natural lash to which the lash extension is to be applied by using a mascara wand or otherwise. Alternatively, the adhesive may be applied to the lash extension prior to applying the lash extension to the natural lash. The process can include causing a lash extension (or another object) to be resiliently grasped (e.g., by hairs, by base) via clamping between the male portion 114 of the first inner side of the first arcuate grasping tip 108 of the first arm 102 of the applicator 100 and the female portion 112 of the second inner side of the second arcuate tip 108 of the second arm 102 of the applicator 100 while the male portion 114 and the female portion 112 mate and the first inner side faces the second inner side. Further, the method can include causing the lash extension (or another object) to be released or placed onto a natural lash of the user (e.g., upper or lower side of upper or lower natural lash). Therefore, the method can enable a self-application of the lash extension via the applicator 100. In an alternative embodiment, a user may use his or her fingers to apply the lash extensions to the natural lashes with the adhesive applied to the natural lashes and/or lash extensions. As such, since the first arm 102 has a first longitudinally extending non-tip portion (e.g., medial portion 106) and the second arm 102 has a second longitudinally extending non-tip portion (e.g., medial portion 106), then the first longitudinally extending non-tip portion and the second longitudinally extending non-tip portion can be lateral to the natural lash (e.g., to right thereof or to left thereof) when the lash extension is released onto the natural lash (e.g., for adhering, magnetizing, fastening, securing).

After the lash extension(s) are placed onto the natural eyelash and weakly adhered thereto by an adhesive, the user may squeeze the tips 108 with the male portion 114 and female portion 112 on the natural lashes and lash extensions, thereby causing the adhesive to better connect the lash extensions to the natural lashes by more evenly distributing the adhesive as the portions 114 and 112 are pressed together. And, because the male portion 114 and female portion 112 may be non-stick material or coated with a non-stick material, the adhesive may not or minimally stick to the portions 114 and 112.

The adhesive, which can be pressure-sensitive, may be a waterproof (semi-permanent) glue, mascara, or some other co-polymer solution having an adhesive quality. Although latex-based adhesives are generally avoided to avoid irritation of the individual's eyelid (e.g., due to an allergic reaction), adhesives can include various other natural and/or chemical ingredients. Examples of possible adhesives include: Arcrylates/ethylhexyl acrylate copolymer, aqua, propylene glycol, ceteareth-25, hydrogenated castor oil, glycerin, phenoxyethanol, 2-bromo-2-nitropropane-1,3-diol, methylcholoroisothiazolinone, methylisothiazolinone, methylparaben, and optionally a color agent (e.g., black 2 (C177266)); Polyterpene, styrene/isoprene copolymer, petrolatum, polyisobutene, microcrystalline wax (cera microcristalina, cire microcrystalline), hydrogenated styrene/methyl styrene/indene copolymer, styrene/VA copolymer, and optionally an antioxidant (e.g., butylated hydroxytoluene (BHT)); Chlorine dioxide, p-anisic acid, biotin, *lavandula* angustifolio oil, propylene glycol, water, 2-ethylhexyl acrylate, and optionally a preservative (e.g., benzalkonium chloride); and Acrylate copolymer and water. Note that many other adhesive compositions are possible and, in fact, may be desirable for individuals having certain allergies, desiring certain fixation duration (also referred to as "permanency" of the lash extensions), or other use cases.

Semi-permanent clusters of lash extensions may be applied with a Federal Drug Administration-approved (FDA-approved) adhesive that achieves a strong bond. Such adhesives generally include cyanoacrylate. Different types of cyanoacrylates (e.g., ethyl, methyl, propyl, butyl, and octyl) have been designed for bonding to different surfaces. For example, adhesives made from methyl-2-cyanoacrylateare are designed to bond a smooth surface (e.g., the lash extension) to a porous surface (e.g., the natural eyelash), but not on the skin as it may cause irritation.

The adhesive may be a semi-permanent glue or mascara. The adhesive can include an oil-soluble polymer or a water-soluble polymer that helps to enhance adhesion and substantivity of the lash extension to the natural eyelashes. The adhesive may be a waterproof formulation that allows the set of lash extensions to remain affixed to the natural lashes for longer periods of time (e.g., days, weeks, or months).

Although latex-based adhesives are generally avoided to avoid eyelid irritation (e.g., due to an allergic reaction), adhesives can include various other natural ingredients (e.g., sugar or honey) and/or chemical ingredients. For example, copolymer is often a main ingredient in many adhesive formulations. The adhesive could be a commercially available adhesive for conventional lash extensions or a specialized composition for use with the set of lash extensions described herein. The adhesive could be clear or colored (e.g., milky white or black to emulate mascara).

The male portion 114 may include one or more protrusions (e.g., one or more protrusions that extend along the inside wall of one of the grasping tips 108) and may be assembled with the first inner side (e.g., fastened, adhered, mated, magnetized, bolted, stapled, nailed, brazed, heat bonded, formed or defined by an inner surface of the grasping tip 108). The female portion 112 may include one or more depressions (e.g., one or more grooves that extend along the inside wall of the other one of the grasping tips 108) and may be assembled with the second inner side (e.g., fastened, adhered, mated, magnetized, bolted, stapled, nailed, brazed, heat bonded, formed or defined by an inner surface of the grasping tip 108). The male portion 114 can be monolithic with the first inner side (e.g., formed from same material). The female portion 112 can be monolithic with the second inner side (e.g., formed from same material).

The male portion 114 or the female portion 112 can be or can avoid being coated with a friction enhancing or reducing coating. For example, a friction enhancing coating can be rubber. Alternatively, the friction reducing coating can be polytetrafluoroethylene (PTFE), silicon, or others. The male portion 114 or the female portion 112 can be treated (e.g., by being powder coated) to improve durability, resistance to scratching, cleanability, resistance to chemicals/solutions, lash extension stickiness, lash extension adhesion, or others. For example, the male portion 114 or the female portion 112 may have a non-stick surface to avoid stickiness or limit the ability to retain adhesive used to apply the lash extensions after squeezing or pinching the tips 108 onto the lashes with the adhesive. Examples of non-stick coatings include PTFE coatings, silicone coatings, or others.

The applicator 100 may be partially or entirely composed of metal (e.g., aluminum, iron, gold, silver, titanium, copper), alloy (e.g., stainless steel, brass), plastic, or some other material (e.g., wood). For example, in some embodiments the applicator 100 may have a smooth powder coating (e.g., for aesthetics and improved cleanability), while in other embodiments the applicator 100 includes a recyclable (i.e., disposable) plastic body that is not intended for significant durations of use (e.g., months or years). For example, in some embodiments plastic may be desirable because it is recyclable and resistant to the adhesives typically applied to the lash extensions before fixation to the natural lashes. For example, the applicator 100 can be composed of metal, plastic, or any other suitable material. Metal alloys (e.g., stainless steel) are typically preferred because they provide greater durability and allow the applicator 100 to have high precision. The term "precision" can refer to the size of objects that can be grasped by the applicator 100. Highly precise grasping tools (e.g., tweezers) can grab very small objects. In order to have high precision, the arms 102 can be precisely aligned and balanced so that an individual can grasp individual artificial lashes. Other materials may also be used to form the applicator 100. For example, the pair of 102 may include of plastic, glass, foam, or other suitable materials. Moreover, the applicator 100 may be formed from a single piece of material rather than a pair of separate fragments. In such embodiments, the single piece of material can be formed into a V-shaped body having opposed arms 102 and the common point 104, i.e., an apex (e.g., via application of heat to central point at which single piece of material is folded).

As shown in FIGS. 1-8, the applicator 100 can be used for applying an artificial lash extension where the applicator 100 has a textured central portion 100 and an arcuate tip 108 that has an internal male 112 or female 114 portion. The applicator 100 has a pair of arms 102 (e.g., metal, plastic) coupled to each other at a common point 104 (e.g., fused, bonded, molded) such that the arms 102 define a V-shape in a default position. Each of the arms 102 has a central portion 106 that is humped and a tip portion 108 that is arcuate. The artificial lash extension can be manufactured manually or automatically (e.g., an industrial machine that feeds or drops or deposits a plurality of artificial lashes onto a surface, applies an electrical charge to the artificial lashes such that the artificial lashes are oriented in a same direction, apply a heating element or hot fluid to common end areas of the artificial lash extensions such that the artificial lash extensions are fused in those to form a cluster of artificial lash extensions is formed).

At least one of the central portions 106 has an external textured portion 110 (e.g., parallel lines, intersecting lines) to help in finger grasping, although at least one of the central portion can be non-textured, such as smooth or otherwise. At least one of the central portions 106 can lack the external textured portion as well. The textured portion 110 can be textured in various ways, such as knurled, hatched, spiked, bumped, or others, whether inward or outward.

At least one of the tip portions 108 can be structured to have an arcuate longitudinal extension that corresponds to an arcuate, longitudinal and outward extension of an external side of an outer sidewall of a case hosting a plurality of artificial lash extensions, as described herein. For example, when both of the tip portions 108 arcuately and longitudinally correspond to the external side of the outer sidewall, then this configuration can enable the tip portions 108 to grasp several of the artificial lash extensions simultaneously from the case. For example, the arcuate longitudinal extension of at least one of the tip portions 108 can structurally correspond or match the curvature of the upper eyelid, which can include an upper waterline or tightline of a user. The tip portions 108 and female/male portions 112/114 may be configured such that when the arms 102 are forced together by The tip portions 108 have opposing inner sides that host female/male portions 112, 114 operative for mating engagement with each other when the tips 108 are moved toward each from the default position via the application of force to the central portions 106 in order to grasp an item, such as an artificial lash extension from a case, via the tip portions 108. The female/male portions 112, 114 may extend along the longitude of the tips 108 in a continuous (e.g., solid line or scattered pattern) or discontinuous manner (e.g., broken line or scattered pattern). As shown, the left arm 102 has a female portion 112 (e.g., U-shape in cross-section) and the right arm 102 has a male portion 114 (e.g., D-shape in cross-section) although this arrangement can be reversed or varied.

The female/male portions 112, 114 can provide a crimping or clamping mechanism, which allows more efficient or impactful or forceful fusion or aid, enable, or cause spreading of the adhesives (e.g., along male projections, within female depressions) so as to make the adhesives less visible (e.g., minimize clumping of adhesives). The crimping or clamping mechanism with the female/male portions 112, 114 may improve fusion of an artificial lash extension with a natural lash by more evenly distributing the adhesive, which may be a relatively soft or fluid adhesive (e.g., ethylhexyl acrylate copolymer) as compared to an adhesive that cures in a hard state (e.g., cyanoacrylates). In an embodiment, a male-to-male portion 114, 114 or female-to-female portion 112, 112 arrangements are possible. Likewise, a male or female portion-to-smooth or flat portion is possible, as well. The female/male portions 112, 114 may be configured to operate as a fusing tool (i.e., a tool to fuse lash extensions to natural lashes) as opposed to a tool configured to shape a lash. The tip portion 108 can be unitary with the central portion 106 or made of same material as the central portion 106 (e.g., metal, alloy, rubber, plastic, etc.). The tip portion 108 can have an inner side that is coated with a friction enhancing or decreasing material (e.g., rubber, plastic, foam, silicon, PTFE, etc.) or the inner side can include a textured portion (e.g., parallel lines, intersecting lines) to help in item grasping, although the inner side can be non-textured, such as smooth or others. The textured portion can be textured in various ways, such as knurled, hatched, spiked, bumped, or otherwise, whether inward or outward.

The tip 108 can be encased in a sock-shaped, tubular, and flexible sheath (e.g., plastic, rubber). When the applicator 100 is used and the arms 102 are pushed inward via the central portions 106 from the default position such that the tips 108 move toward each other to grasp an item, such as an artificial lash extension from a case, the central portions 106 may be configured not to contact each other, thereby defining a gap there between. Note that the applicator 100 can be configured to clamp or crimp. For example, the applicator 100 can clamp when the applicator 100 hosts a ratcheting mechanism (e.g., gear and pawl) between the arms 102 that controls inward movement of the arms 102 when the arms are pushed inward via the central portions 106 from the default position such that the tips 108 move toward each other to grasp an item and then remain in that position, which can include the grasping position, if the arms 102 are let go or the application of forces ceases.

FIGS. 9-16 show a plurality of views of an embodiment of an applicator according to this disclosure. In particular, an applicator 200 can be similar in functional operation to the applicator 100 with a different shape. In particular, the applicator 200 has a pair of arms 202, a pair of medial portions 204, a pair of tips 206, a dimpled portion 208, a pair of arcuate portions 210, a female portion 212, a plurality of pairs of bulges 214, a male portion 216. As such, the first grasping tip 206 or the second grasping tip 206 can be respectively transverse or at least partially perpendicular to the first arm 202 and/or the second arm. Further, at least one of the medial portions 204 is dimpled via the dimpled portion 208. Also, the dimpled portion 208 can be textured, as in the applicator 100. Moreover, the first arcuate portion 210 defining a first grasping tip is bulged on both ends thereof and the second arcuate portion 210 defining a second grasping tip may be bulged on both ends.

The applicator 100 can be used to perform a process of applying false eyelashes to natural eyelashes. A user may initially apply an adhesive to a natural lash to which the lash extension is to be applied by using a mascara wand or otherwise. Alternatively, the adhesive may be applied to the lash extension prior to applying the lash extension to the natural lash. The process can include causing a lash extension (or another object) to be resiliently grasped (e.g., by hairs, by base) via clamping between the male portion 216 of the first inner side of the first arcuate portion 210 of the first arm 202 of the applicator 200 and the female portion 212 of the second inner side of the second arcuate portion 210 of the second arm 202 of the applicator 200 while the male portion 216 and the female portion 212 mate and the first inner side faces the second inner side. Further, the method can include causing the lash extension (or another object) to be released or placed onto a natural lash of the user (e.g., upper or lower side of upper or lower natural lash). Therefore, the method can enable a third-party-application of the lash extension via the applicator 200. In an alternative embodiment, a user may use his or her fingers to apply the lash extensions to the natural lashes with the adhesive applied to the natural lashes and/or lash extensions. Since the first arcuate portion 210 is transverse to the first arm 202 and the second arcuate portion 210 is transverse to the second arm 202, then the first arm 202 and the second arm 202 longitudinally extend away from the natural lash when frontal to the natural lash and when the lash extension is released or placed onto the natural lash.

As shown in FIGS. 9-16 the applicator 200 can be used for applying an artificial lash extension where the applicator 200 has a dimpled central portion 208 and a pair of "snail-head" shaped arcuate portions 210 that have female or male portions 212, 216 disposed on inside surfaces of the second arcuate portion 210. The applicator 200 has a pair of arms 200 (e.g., metal, plastic) coupled to each other at a common point (e.g., fused, bonded, molded) such that the arms define a V-shape in a default position. Each of the arms 202 has the central portion 204 that is inwardly dimpled at the dimpled portion 208 so as to help a user operate the applicator 200 and a tip portion 210 that is arcuate (e.g., C-shaped, V-shaped, U-shaped) and bulged on opposing arcuate ends 214. It should be understood that the bulging at the ends 214 is illustrative, and alternative embodiments may not include the bulged ends 214. The dimpled portion 208 can be textured (e.g., parallel lines, intersecting lines) to help in finger grasping, although the dimpled portion 208 can be non-textured, such as smooth or others. The dimpled portion 208 can be textured in various ways, such as knurled, hatched, spiked, bumped, or others, whether inward or outward.

At least one of the tip portions 210 can be structured to have an arcuate longitudinal extension that corresponds to an arcuate, longitudinal and outward extension of an external side of an outer sidewall of a case hosting a plurality of artificial lash extensions, as described herein. For example, when both of the tip portions 210 arcuately and longitudinally correspond to the external side of the outer sidewall, then this configuration can enable the tip portions 210 to grasp several of the artificial lash extensions simultaneously from the case. For example, the arcuate longitudinal extension of at least one of the tip portions 210 can structurally correspond or match the curvature of the upper eyelid, which can include the upper waterline or tightline of the user on which lash extensions are being placed.

The arcuate portions 210 have opposing inner sides that host female/male portions 212, 216 operative for mating engagement with each other when the arcuate portions 210 are moved toward each from the default position via the applications of force to the central portions 204 in order to grasp an item, such as an artificial lash extension from a case, via the arcuate portions 210. The male/female portions 212, 216 can be extending along the longitude of the arcuate portions 210 in a continuous (e.g., solid line or scattered pattern) or discontinuous manner (e.g., broken line or scattered pattern). As shown, the left arm 202 has a female portion 212 (e.g., U-shape in cross-section) and the right arm 202 has a male portion 216 (e.g., D-shape in cross-section) although this arrangement can be reversed. The male/female portions 212, 216 provide a crimping or clamping mechanism, which allows more efficient or impactful or forceful fusion or aid, enable, or cause spreading of the adhesives (e.g., along male projections and within female depressions or indentations) so as to make the adhesives less visible (e.g., minimize clumping of adhesives). The crimping or clamping mechanism with the female/male portions 212, 216 may improve fusion of an artificial lash extension with a natural lash by more evenly distributing the adhesive, which may be a relatively soft or fluid adhesive (e.g., ethylhexyl acrylate copolymer) as compared to an adhesive that cures in a hard state (e.g., cyanoacrylates). In an embodiment, a male-to-male portion 216 or female-to-female portion 212 arrangements are possible. Likewise, a male or female portion-to-smooth or flat portion is possible, as well. The female/male portions 212, 216 may be configured to operate as a fusing tool (i.e., a tool to fuse a lash extension formed of multiple fibers to natural lashes) as opposed to a tool configured to shape a lash. The arcuate portion 210 can be unitary with the central portion 204 or made of same material as the central portion 204 (e.g., metal, rubber, plastic, etc.). The arcuate portion 210 can have an inner side that is coated with a friction enhancing or reducing material (e.g., rubber, plastic, foam, silicon, PTFE, etc.) or the inner side can include a textured portion (e.g., parallel lines, intersecting lines) to help in item grasping, although the inner side can be non-textured, such as smooth or others. The textured portion can be textured in various ways, such as knurled, hatched, spiked, bumped, or others, whether inward or outward.

Figure 17B:
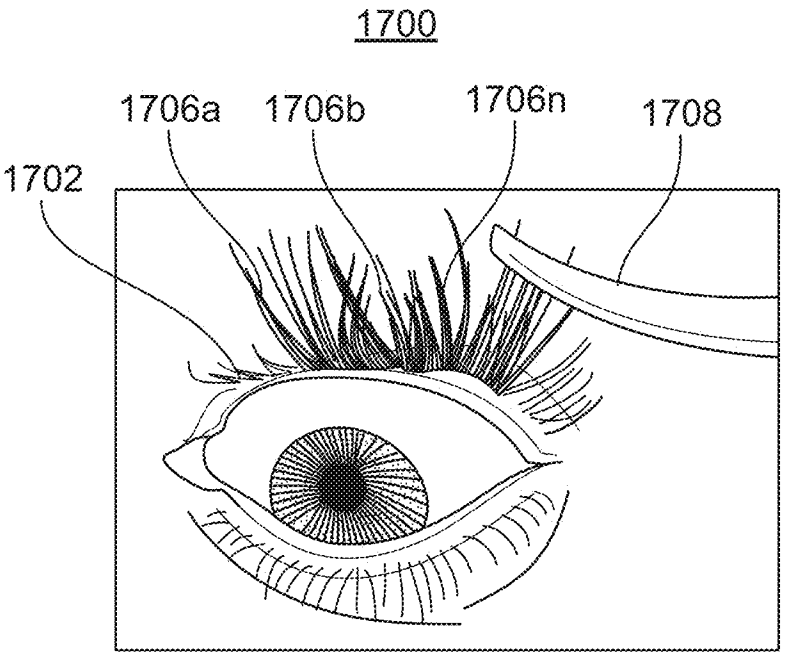
FIGS. 17A-17C show a sequence of respectively applying an adhesive to natural lashes, positioning lash extensions on the natural lashes, and using an applicator to fuse the lash extensions to the natural lashes by evenly distributing the adhesive with male/female features on the tips.
Figure 17A:
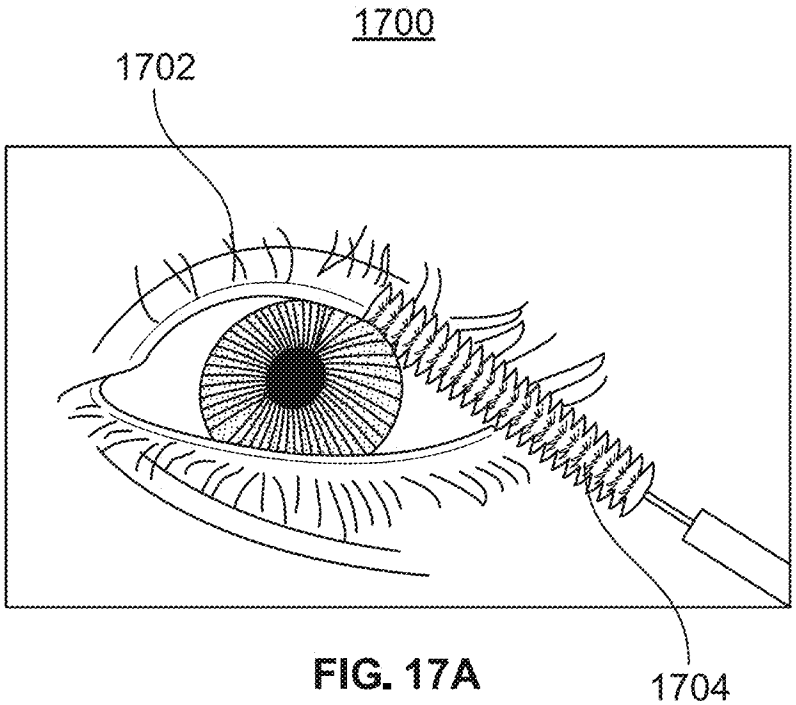
Figure 17C:
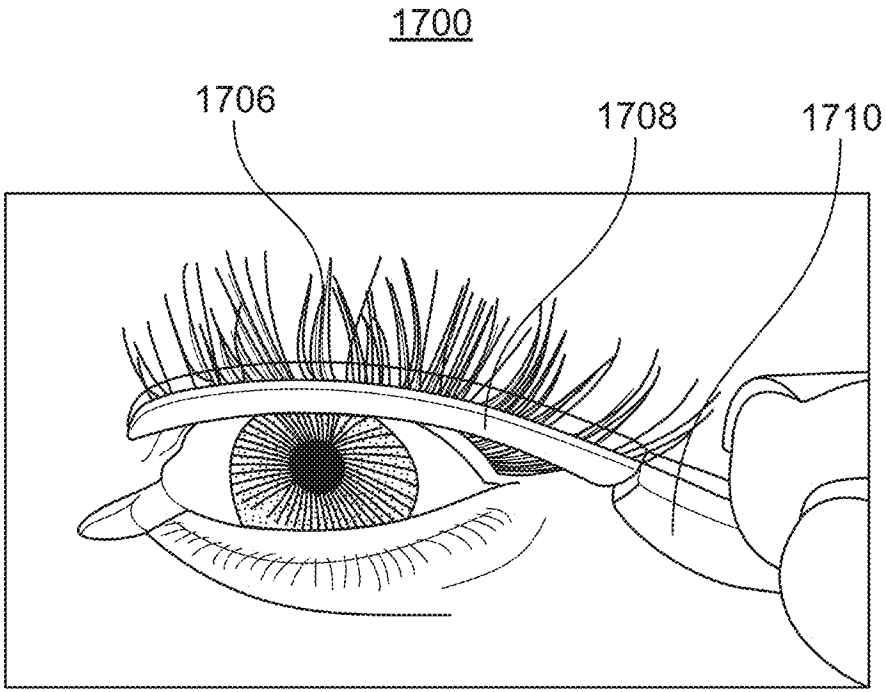

FIGS. 17A-17C show a sequence of respectively applying an adhesive to natural lashes, positioning lash extensions on the natural lashes, and using an applicator to fuse the lash extensions to the natural lashes by evenly distributing the adhesive with male/female features on the tips. The process may start in FIG. 17A, where an eye 1700 including natural eyelashes 1702 may have an adhesive applicator 1704 apply a flexible adhesive to the natural lashes 1702 to the lower side of the natural lashes. The adhesive applicator 1704 may be a conventional mascara wand or a wand that is specifically designed to apply the flexible adhesive. Although the application of the adhesive by the adhesive applicator 1704 may be relatively even across the natural lashes 1702, the adhesive may have some level of inconsistency (e.g., globs or more adhesive in some areas and less in other areas of the natural lashes). As a result of the adhesive being soft and fluid, a user may be able to spread or redistribute the adhesive later on (see FIG. 17C).

As shown in FIG. 17B, after the adhesive has been applied to the natural eyelashes 1702 (or alternatively or additionally to the upper side of the lash extensions) in FIG. 17A, lash extensions **1706*a*-1706*n* (collectively 1706) may be placed on a lower side of the natural eyelashes 1702, such that an upper side of the lash extensions 1706 is tacked or otherwise attached to the natural eyelashes 1702 by contacting the lash extensions 1706 to the adhesive on the natural lashes 1702 (or the adhesive on the lash extensions 1706 to the natural lashes 1702). Because the lash extensions 1706 in this case are light (e.g., heat-fused fibers), the tackiness of the adhesive may be sufficient to hold the lash extensions 1706 in place. In placing the lash extensions 1706, a user may hold one more set of the lash extensions 1706 by a tip 1708 including a first and second tip extending from first and second arms of an applicator 1710, as previously provided. The tip 1708 may have protrusions and recessions disposed on respective inside surfaces of the tip 1708**.

As shown in FIG. 17C, the user may rotate the applicator 1710, such that a curvature of the tip 1708, which in this case has an arcuate shape, may extend along the natural eyelashes 1702 and lash extensions 1706, where one of the tips may be on one side of the natural lashes 1702 and the other one of the tips may be on the other side of the natural lashes 1702. As the user applies force to the arms of the applicator 1710 to cause the first tip and second tip to simultaneously squeeze or apply force to the adhesive, natural lashes 1702, and lash extensions 1706 so as to cause the adhesive to be distributed along a channel formed by the depression of the female portion of one of the tips as the protrusion of the male portion of the other one of the tips extends into the depression. That is, the soft adhesive will be more evenly distributed along the natural lashes 1702 and lash extensions 1706, thereby fusing the natural lashes 1702 and lash extensions 1706 together in a more seamless way. The squeezing of the tips may also cause the lash extensions 1706 to be better matted to the natural lashes 1702.

Figure 18B:
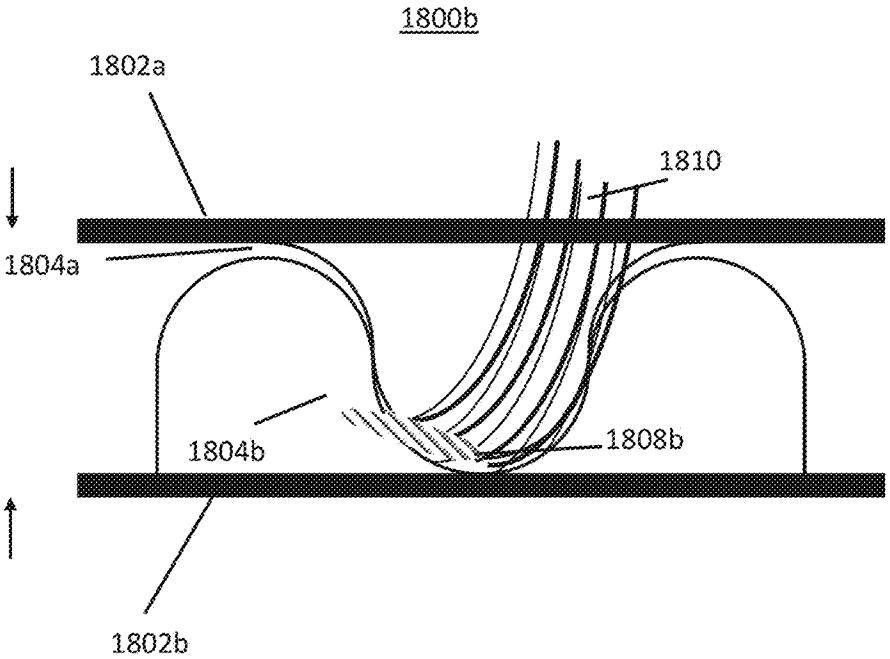
FIGS. 18A-18B show a sequence of using tips with male/female features of an applicator to fuse natural lashes and lash extensions.
Figure 18A:
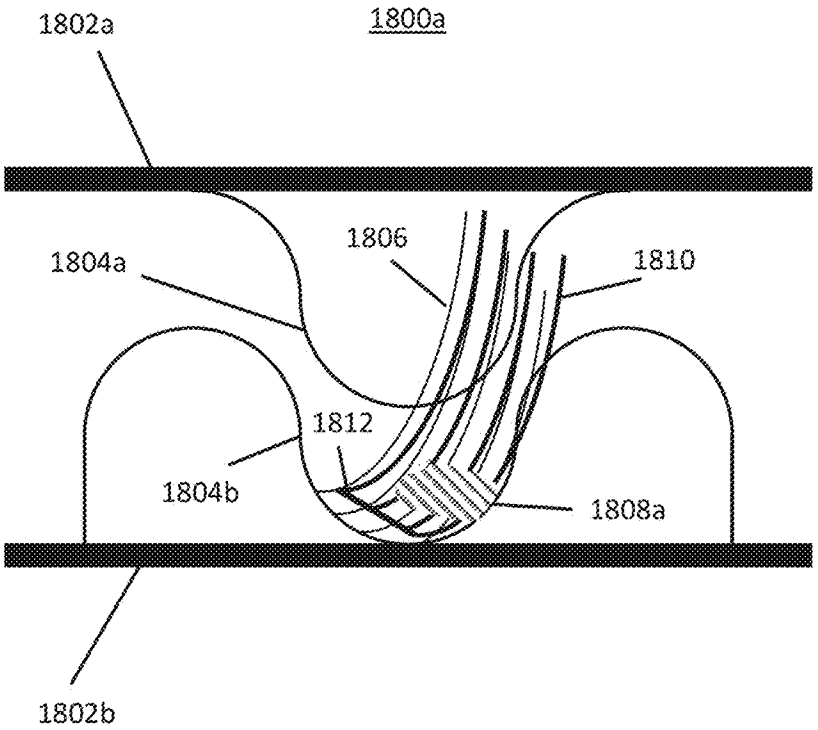

FIGS. 18A-18B show a sequence of using tips with male/female features of an applicator to fuse natural lashes and lash extensions. As shown in FIG. 18A, an open state

1800*a*, which may be a default state, of tips 1802*a* and 1802*b* (collectively 1802) of an applicator results in a separation between a protrusion 1804*a* that defines a male portion and a depression or recess 1804*b* that defines a female portion, where the protrusion 1804*a* and recess 1804*b* may be disposed on the respective tips 1802*a* and 1802*b*. The protrusion 1804*a* may be elongated and extend along the tip 1802*a*, and the recession 1804*b* may be elongated and extend along the tip 1802*b*. Natural lashes 1806 may have an adhesive applied to the underside, for example, of the natural lashes 1806 to form an adhesive region 1808*a*. A lash extension 1810 may be placed or contacted with the natural lashes 1806 and held by the tackiness of the adhesive in the adhesive region 1808*a*. The lash extension 1810 is shown to have a base 1812, which, in one embodiment, may be heat-fused so as to be thin (e.g., between 0.05 mm and 0.15 mm). It should be understood that alternative lash configurations may be utilized.

As shown in FIG. 18B, as the protrusion 1804*a* of the male portion is pressed into the depression 1804*b* of the female portion with the natural lashes 1806 and lash extension 1810 being held by the adhesive, the adhesive region 1808*a* may be compressed and traverse within a channel formed between the protrusion 1804*a* and depression 1804*b*, thereby causing the adhesive region 1808*a* to be redistributed to become adhesive region 1808*b*. The adhesive region 1808*b* may result in a more evenly distributed adhesion region, thereby causing a fusion between the natural lashes 1806 and lash extension 1810 to be stronger.

Another embodiment of a process for applying lash extensions to natural lashes may include causing an adhesive holding the lash extension formed of multiple fibers and natural lashes together to be simultaneously grasped between at least one protrusion defining a male portion of a first inner side of a first tip of a first arm disposed on an applicator and at least one depression that defines a female portion disposed on a second inner side of a second tip of a second arm of the applicator, thereby causing the adhesive to be spread along a region between the male and female portions.

The process may further include comprising causing the male and female portions to separate after being simultaneously grasped, thereby causing the lash extension to be adhered to the natural lashes with the adhesive more evenly distributed across the lash extension and natural lash. In simultaneously grasping, the first and second tips may be aligned to extend longitudinally across the natural lashes of an eye prior to simultaneously grasping.

One embodiment of a method for redistributing an adhesive applied to a lash extension formed of multiple fibers and natural lashes may include causing the adhesive disposed on the natural lashes and lash extension to extend along a surface of an elongated depression disposed on a first tip of a first arm of an applicator and a surface of an elongated protrusion disposed on a second tip of a second arm when the elongated protrusion is vertically extended into the elongated depression with the adhesive, natural lashes, and lash extension being positioned between the elongated depression and elongated protrusion. The process may further include causing the adhesive to have reduced adhesion to either of the surfaces of the elongated depression or elongated protrusion One embodiment of a method of manufacturing an applicator may include forming a first arm including a first grasping tip having a first inner side including at least one protrusion that defines a male portion, and forming a second arm including a second grasping tip having a second inner side including at least one depression that defines a female portion. The first and second arms may be connected at a first end opposite a second end at which the first and second grasping tips are located, and with the first inner side facing the second inner side. The male portion and the female portion may be aligned with one another so that when the first arm and the second arm are in an open position, the male and female portions are separated from one another, and when the first arm and second arm are in a closed position, the male portion and the female portion mate with one another.

Forming the first arm may include applying the male portion to the first inner side, and forming the second arm may include applying the female portion to the second inner side. Forming the first arm may include forming the male portion on the first inner side of the first grasping tip, and forming the second arm may include forming the female portion on the second inner side of the second grasping tip.

It should understood that the applicators be embodied in many different forms and should not be construed as necessarily being limited to the embodiments disclosed herein. Rather, the embodiments provided herein are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the embodiments.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

The terminology used herein is for describing particular example embodiments and is not intended to be necessarily limiting of the present disclosure. As used herein, the singular forms "a," "an" and "the" are intended to include the plural forms as well, unless the context clearly indicates otherwise. Also, as used herein, the term "a" and/or "an" shall mean "one or more," even though the phrase "one or more" is also used herein. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof. Furthermore, when the present disclosure states herein that something is "based on" something else, then such statement refers to a basis which may be based on one or more other things as well. In other words, unless expressly indicated otherwise, as used herein "based on" inclusively means "based at least in part on" or "based at least partially on."

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, a gemstone, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical to and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

Although preferred embodiments have been depicted and described in detail herein, skilled artisans can make various modifications, additions, substitutions and the like can be made without departing from this disclosure, and these are, therefore, considered to be within scope of this disclosure, as claimed.

The invention claimed is:

1. An applicator for an artificial lash extension comprising:

a pair of opposing arms comprising a first arm and a second arm, wherein the first arm and the second arm are joined at proximal ends to form a hinge, each of the first and second arms comprising:

a first side opposite a second side, and an interior surface opposite an exterior surface, wherein the interior surface and the exterior surface extend between the first side and the second side;

a medial section extending distally from the proximal end; and a grasping section extending distally from the medial section, the grasping section comprising an arcuate portion orientated transverse to the medial section, the arcuate portion having a concave curvature facing opposite the proximal end and a convex curvature opposite the concave curvature, wherein a portion of the interior surface corresponding to the grasping section of the first arm comprises a male portion defined by a protrusion having a first arcuate contour corresponding to at least part of the concave curvature and the convex curvature of the arcuate portion of the grasping section; and wherein a portion of the interior surface corresponding to the grasping section of the second arm comprises a female portion defined by at least one depression having a second arcuate contour corresponding to at least part of the concave curvature and the convex curvature of the arcuate portion of the grasping section, wherein the male portion and the female portion are designed to crimp natural lashes and the artificial lash extension that are disposed therebetween.

2. The applicator of claim 1, wherein the male portion comprises an edge at an apex of the male portion.

3. The applicator of claim 2, wherein the male portion comprises a first surface facing opposite the proximal end of the first arm, the first surface having a curvature extending between the apex of the male portion and the interior surface of the grasping section of the first arm.

4. The applicator of claim 3, wherein the male portion comprises a second surface opposite the first surface, the second surface that is substantially flat and that extends between the apex and the interior surface of the grasping section.

5. The applicator of claim 2, wherein the female portion protrudes from the interior surface of the grasping section.

6. The applicator of claim 5, wherein the female portion comprises a first interior surface that intersects a second interior surface of the female portion at a line of intersection.

7. The applicator of claim 6, wherein the line of intersection is concave line that corresponding to at least part of the concave curvature of the arcuate portion of the grasping section of the second arm.

8. The applicator of claim 6, wherein the apex of the male portion corresponds to the line of intersection of the female portion.

9. The applicator of claim 1, wherein the grasping section of each of the first and second arms comprises:

a pair of terminal distal ends, each of the terminal distal ends comprising a bulge.

10. The applicator of claim 1, wherein at least one of the medial section of the first arm or the medial section of the second arm comprises:

a dimpled portion defined by a depression in the medial section.

11. The applicator of claim 10, wherein the dimpled portion is at least in part textured.

12. The applicator of claim 1, wherein the male portion is fastened to the first arm, and the female portion is fastened to the second arm.

13. The applicator of claim 1, wherein the male portion is monolithic with the portion of the interior surface corresponding to the grasping section of the first arm, and wherein the female portion is monolithic with the portion of the interior surface corresponding to the grasping section of the second arm.

14. The applicator of claim 1, wherein the male portion and the female portion are coated with a friction reducing coating.

15. The applicator of claim 1, wherein the male portion comprises a single continuous protrusion.

16. The applicator of claim 1, wherein the applicator is configured to transition from an open position to a closed position, in the open position the male portion and the female portion are separated from one another, and in the closed position the male portion and the female portion mate with one another, wherein the open position of the applicator is a default position, and wherein an application of pressure to the exterior surface of each arm of the applicator transitions the applicator from the open position to the closed position.

17. The applicator of claim 1, wherein the male portion and the female portion are designed to mate to grasp hairs of the artificial lash extension.

18. The applicator of claim 17, wherein the male portion and the female portion of the applicator are designed to mate with one another to bond the artificial lash extension to a lower side of natural eyelashes.

19. The applicator of claim 18 wherein the male portion and the female portion are designed to redistribute an adhesive among the artificial lash extension and the natural eyelashes.

20. The applicator of claim 1, comprising at least one of a metal or metal alloy.

* * * * *